US006967277B2

(12) United States Patent
Querfurth

(10) Patent No.: US 6,967,277 B2
(45) Date of Patent: Nov. 22, 2005

(54) AUDIO TONE CONTROLLER SYSTEM, METHOD, AND APPARATUS

(75) Inventor: William Querfurth, Phoenix, AZ (US)

(73) Assignee: William Robert Querfurth, Phoenix, AZ (US)

( * ) Notice: Subject to any disclaimer, the term of this patent is extended or adjusted under 35 U.S.C. 154(b) by 217 days.

(21) Appl. No.: 10/640,112

(22) Filed: Aug. 12, 2003

(65) Prior Publication Data

US 2005/0034590 A1 Feb. 17, 2005

(51) Int. Cl.[7] ..... G10H 7/00
(52) U.S. Cl. ..... 84/645; 704/265; 84/617; 84/604; 715/838
(58) Field of Search ..... 84/645, 617, 604, 84/477 R, 478; 704/265; 715/838; 318/561; 381/61

(56) References Cited

U.S. PATENT DOCUMENTS 4,395,930 A * 8/1983 Deforeit ..... 84/617
4,412,161 A * 10/1983 Cornaby ..... 318/561
4,991,218 A * 2/1991 Kramer ..... 381/61
5,086,475 A * 2/1992 Kutaragi et al. ..... 704/265
5,680,558 A * 10/1997 Hatanaka et al. ..... 715/838
6,239,346 B1 * 5/2001 Goto et al. ..... 84/604

* cited by examiner

*Primary Examiner*—David Martin
*Assistant Examiner*—Jianchun Qin

(57) ABSTRACT

Embodiments of the invention comprise a new device and technique to realize a utilization for providing a system, method, and apparatus for providing an improved audio tone control and generation. More specifically, embodiments of the present invention relate to systems, methods, and apparatuses for an electronically improved audio tone control and generation that is adaptable for utilization in cooperation with a Musical Instrument Digital Interface ("MIDI"). In a business method embodiment, the user may pay a monthly fee or a licensing fee for an audio tone control and generation service, or alternatively may pay a per-session fee or a fee based upon data size and/or amount of data manipulation.

14 Claims, 18 Drawing Sheets

(section of switch array)

To UART load enable >
To UART parallel >
Tri-state
enable "high"
Tri-state buffer
enable "high"
16 to 8
multiplexor
CP*
P**
+V
256 bit
Shift Register
D type latch
W/Reset
Multiplexor ( 256 to 1 )
Data input from keyboard (Figure 2)
eight bit ctr
(clock)
(subclock)
** reserved for placement data
* reserved for channel placement data

FIGURE 6

With (clock) Pulse Generating Device referred to in the section "Data Entry" low;

1) Note Data from placement logic (Raw data from the 4's place (3rd bit) of Binary Counting Device referred to in the section "Data Entry") 215

2) Note Data from placement logic (Raw data from the 8's place (4th bit) of Binary Counting Device referred to in the section "Data Entry") 220

3) Note Data from placement logic (Raw data from the 16's place (5th bit) of Binary Counting Device referred to in the section "Data Entry") 230

4) Note Data from placement logic (Raw data from the 32's place (6th bit) of Binary Counting Device referred to in the section "Data Entry") 240

5) Note Data from placement logic (Raw data from the 64's place (7th bit) of Binary Counting Device referred to in the section "Data Entry") 250

6) Note Data from placement logic (Raw data from the 128's place (8th bit) of Binary Counting Device referred to in the section "Data Entry") 260

7) Note Data from placement logic. 270

8) Note Data from placement logic. 280

All data to UART collected directly from placement logic and binary counter except note on/off bit from note data, UART triggered by (subclock) pulse generator, visibility triggered by note data

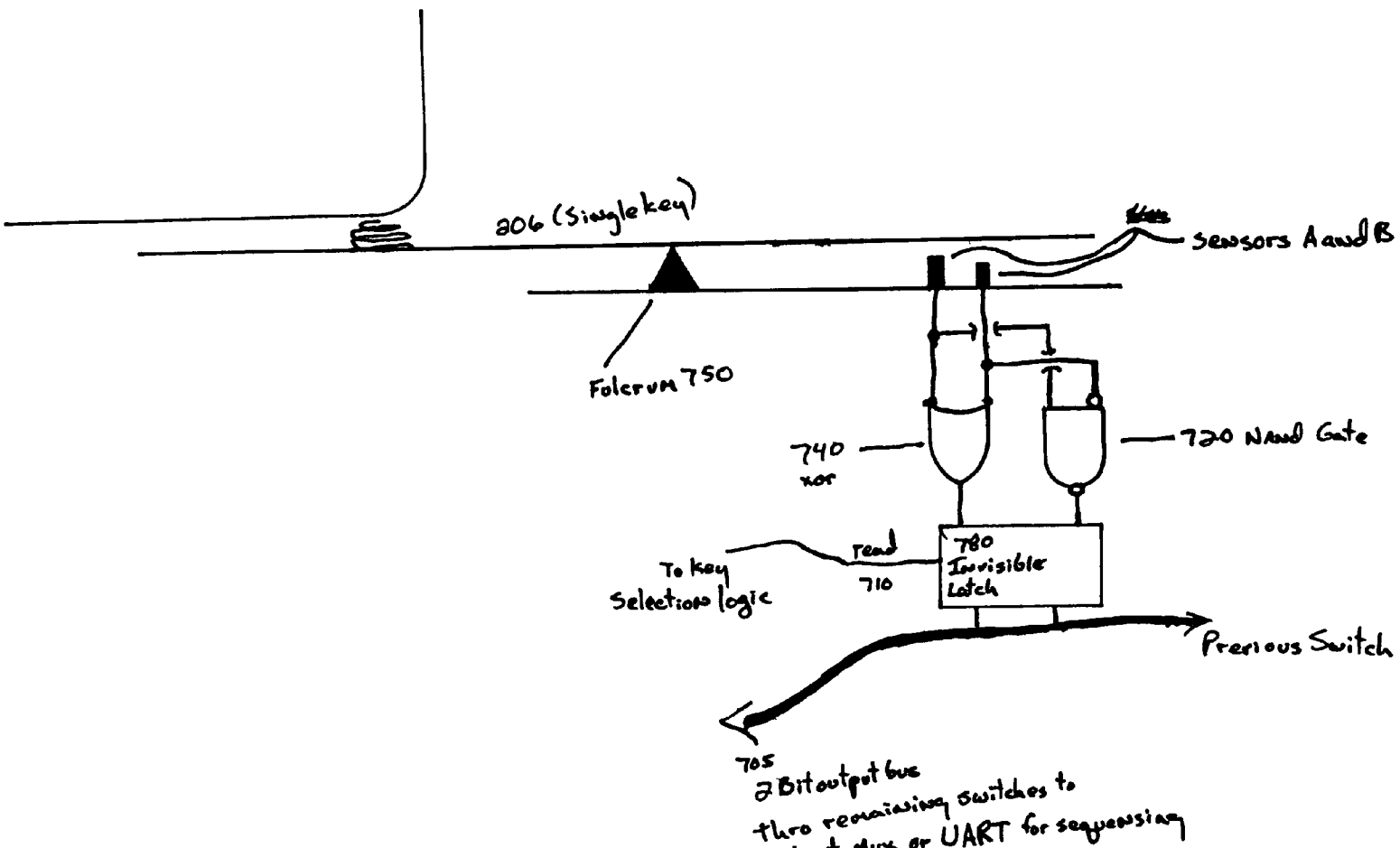
Figure 7 (one possible two bit pressure sensing system)

IF $206_n$ = YES
AND $521_n$ = YES
AND NEXT $206_{(n+1)}$ = NO
THEN SEND TO
PHASE LOCKED LOOP
AT 361

Figure 12 logic for secondary loop

Figure 14. Ergonomic pressure sense logic (variation)
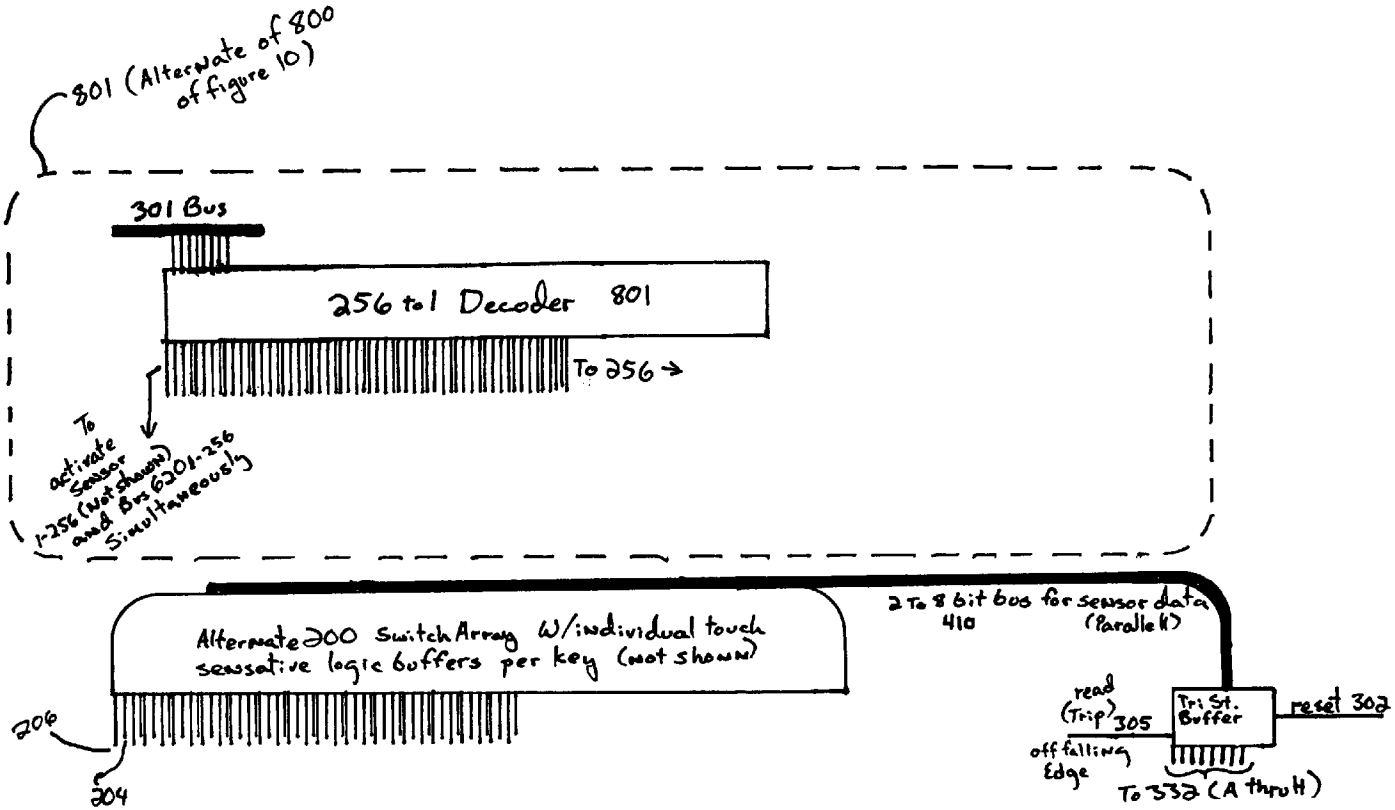

AUDIO TONE CONTROLLER SYSTEM, METHOD, AND APPARATUS

BACKGROUND OF THE INVENTION

The present invention relates generally to a system, method, and apparatus for providing an improved audio tone control and generation. More specifically, embodiments of the present invention relate to systems, methods, and apparatuses for an electronically improved audio tone control and generation that is adaptable for utilization in cooperation with, e.g., a Musical Instrument Digital Interface ("MIDI").

DESCRIPTION OF THE PRIOR ART

The creation of the first stringed instruments and toned percussion devices, for example the marimba and timbale, helped to move music generation into a multiple toned capability by progressing from a strictly human vocal tone generation to a manual tone generation. This manual tone generation made the performance of musical ideas possible for those not endowed with a publicly accepted vocal timbre.

Next, the frets of many stringed instruments came to represent the division of the audible spectrum into the harmonically implied western twelve tone per octave system (hereinafter "twelve tone system") of tone generation. Although intended as an aid to proper performance, the frets can be restrictive. Some of this restriction may sometimes be negated by such techniques as the bending of a string, utilizing "wa-wa" bars, and the actual bending of the neck of a guitar to produce tones and effects not allowed for in the conventional musical instrument design.

Conventionally, the clavichord and pianoforte represent the most comprehensive linear expression of the twelve tone system to date. The black and white keys represent a functional simplification of the twelve tone system with a bias implied to the foundational key of C major, although the same pattern could be applied to any foundational tone. However, the restrictions of these conventional instruments have been unable to be truly overcome for several reasons, including the lack of access to the origination of the tone and the tension of the string.

The synthesizer responded to and attempted to overcome some of these shortcomings with the creation of a tone wheel, a wa-wa bar, tremolo switches and a host of modes of generation such as portimento.

Also, as an exemplary prior art synthesizer, a conventional MIDI device may be utilized to attempt to partially satisfy the necessity for a greater tonal expression. Conventionally, MIDI is a powerful tool for composers and musicians. MIDI allows musicians to be more creative both on stage and in the studio. MIDI also allows composers to write music that no human could ever perform. However, MIDI is not a tangible object. Instead, MIDI is a communications protocol that allows electronic musical instruments to interact with each other.

Conventionally, the MIDI protocol is utilized to allow music synthesizers to communicate. Thus, much in the same way that two computers communicate via modems, two synthesizer devices communicate via MIDI. The information exchanged between two MIDI synthesizer devices is musical in nature. In its most basic mode, the MIDI protocol, or information, tells a synthesizer device when to start and stop playing a specific note. Other MIDI information shared includes the volume and modulation of the note, if any.

MIDI information can also be more hardware specific. The MIDI information can tell a synthesizer to change the sounds, master volume, modulation devices, and even how to receive information. In more advanced conventional uses, MIDI information can be utilized to indicate the starting and stopping points of a song or the metric position within a song. More recent conventional applications include using the interface between a computer and a synthesizer device to edit and store sound information for the synthesizer on the computer.

The basis for MIDI communication is the byte. Through a combination of bytes, a vast amount of information can be transferred. Each MIDI command has a specific byte sequence. The first byte is the status byte, that tells the MIDI device what function to perform. Encoded in the status byte is the MIDI channel. In a conventional solution, MIDI operates on 16 different channels, numbered 0 through 15. MIDI units will accept or ignore a status byte depending upon what channel the machine is set to receive. Conventionally, only the status byte has the MIDI channel number encoded. Thus, all other bytes are assumed to be on the channel indicated by the status byte until another status byte is received.

Some of these functions to be performed, that are indicated in the status byte, include Note On, Note Off, Patch Change, and System Exclusive (SysEx). Depending upon the status byte, a number of different byte patterns will follow. For example, the Note On status byte tells the MIDI device to begin sounding a note. Then, two additional bytes are required, a pitch byte, which tells the MIDI device which note to play, and a volume byte, that tells the device how loud to play the note. Even though not all MIDI devices recognize the volume byte, it is still required to complete the Note On transmission.

The command to stop playing a note is not part of the Note On command. Instead, there is a separate Note Off command to stop playing a note. This Note Off command also requires two additional bytes with the same functions as the Note On byte. Conventionally, this approach to Note On and Note Off is considered a necessity of the MIDI structure.

Conventionally, another important status byte is the Patch Change byte. The Patch Change byte requires only one additional byte. This additional byte is the number corresponding to the program number on the synthesizer. The patch number information is different for each synthesizer. Generally, however, the standards have been set by the International MIDI Association ("IMA"). Of course, the channel selection is extremely helpful when sending Patch Change commands to a synthesizer.

Conventionally, the SysEx status byte is the most powerful and yet the least understood of the status bytes, because the SysEx status byte can instigate a variety of functions. Briefly, the SysEx byte requires at least three additional bytes. The first additional byte is a manufacturer's ID number or timing byte. The second additional byte is a data format or function byte. Finally, the third additional byte is generally an "end of transmission" ("EOX") byte.

A conventional MIDI interface utilizes three 5-pin ports found on the back of a MIDI unit. Labeled IN, OUT, and THRU, these ports control all of the information routing in a MIDI system. The IN port accepts MIDI data, i.e., the data coming "in" to the unit from an external source. This external source data, or inbound data, is the data that controls the sound generators of the synthesizer.

The OUT port sends MIDI data "out" to the rest of the MIDI setup. This outbound data, exiting via the OUT port, results from activity of the synthesizer, such as key presses, and patch changes. In a different manner from the OUT port, the THRU port also sends data out to the MIDI system. The data coming from the THRU port is an exact copy of the data received at the synthesizer's IN port. There is no change made to the inbound data from the time it arrives at the IN port until the time it leaves the THRU port, i.e., the relatively very small time period from the arrival of the data at the IN port until the data leaves the THRU port.

MIDI makes use of a special five conductor pin cable to connect the synthesizer ports. Conventionally, however, only three of these five conductors are actually used. Specifically, (not shown) data is carried through the cable on conductor pins 1 and 3, and conductor pin 2 is shielded and connected to common. Thus, conductor pins 4 and 5 remain unused. Conventionally, MIDI cable is specially grounded and shielded to ensure efficient data transmission. This special cable construction requires that MIDI cable is a little more expensive than standard 5-conductor pin cable, but reliable data transmission is necessary for MIDI.

The length of the cable is critical as well. IMA specifications suggest an absolute maximum cable length of 50 feet because of the method of data transmission through the cable. The entire length of a MIDI chain that is described in detail below is unlimited, however, provided that none of the links are longer than 50 feet. Conventionally, an optimal maximum length for cable is about 20 feet, and most commercially manufactured cable comes in five to ten foot lengths.

Conventional connections are referred to as MIDI chains and loops. A MIDI chain describes a series of one-way connections in a MIDI setup. The elemental chain is a single-link chain. The MIDI OUT port of one device is connected to the MIDI IN port of a second. In this configuration, a key pressed on the first unit will cause both units to sound. Pressing a key on the second unit, however, only causes the second unit to sound. Many instruments may be chained together using a series of single links to connect the units. In this case, the OUT of the first unit is connected to the second, the THRU of the second is connected to the IN of a third, and so on. If all the units are set to receive on the same channel, pressing a key on the first one will cause all the units to sound. Pressing a key on any of the other units will only activate the sound of that unit.

A MIDI loop is a special configuration of a MIDI chain. The single element loop is made of two interconnecting links. The OUT port of the first unit is connected to the IN port of the second, and the OUT port of the second is connected to the IN port of the first. In this case, as described earlier, a key pressed on either unit causes both units to sound, provided they are on the same channel. A MIDI feedback loop does NOT exist here, as the data going into the second unit from the first is not duplicated in the OUT port of the second going back into the first. Here, we have two one-way links connected, rather than a multi-link chain.

MIDI loops connecting several devices using all three ports can become complex very quickly. As a brief example, consider four synthesizers "A, B, C, and D" 1 that are illustrated in FIG. 1. Synthesizer A's OUT port 2 is connected to Synthesizer B's IN port 16 via an A to B connector wire 50, and consequently to Synthesizer C's IN port 26 via Synthesizer B's THRU port 14 via a B to C connector wire 52. Synthesizer B's OUT port 12 connects via a B to D connector wire 54 to Synthesizer D's IN port 36, and Synthesizer D's THRU port 34 connects via a D to A connector wire 56 to Synthesizer A's IN port 6. Synthesizer C's THRU port 24 and OUT port 22 and Synthesizer D's OUT port 32 are not connected in FIG. 1.

Thus, because of the connections shown in FIG. 1, a key pressed on Synthesizer A sounds Synthesizer A, B and C. However, a key pressed on Synthesizer C sounds only Synthesizer C. Somewhat similarly, a key pressed on Synthesizer B sounds Synthesizers B, D, and A, while a key pressed on Synthesizer D sounds only Synthesizer D. Synthesizer C does not sound when Synthesizer B is pressed because there is no direct connection between Synthesizer B and Synthesizer C, and Synthesizer B's note, which does route through Synthesizer D, does not route through Synthesizer A into Synthesizer C because Synthesizer A's THRU port 4 is not connected to Synthesizer C, or to anything else for that matter. For a similar reason, it is understood that a note played on Synthesizer A does not sound on Synthesizer D.

Computer manufacturers soon realized that the computer would be a good tool for MIDI, because MIDI devices and computers speak the same language. A conventional MIDI data transmission rate may conventionally be 31.5 kBaud. This MIDI data rate is different from a conventional computer data rate of, e.g., 9.6 kBaud, i.e., via modems. Thus, manufacturers had to design a MIDI interface to allow the computer to talk at MIDI's speed. Apple Computers, with the Macintosh and Apple II series, and Commodore were the first companies to provide a MIDI interface. Roland designed a MIDI interface for the IBM series of compatible computers a few years later, and Atari designed a completely new computer, the ST series, with fully operable MIDI ports built in. Today, there are many different MIDI interfaces available for almost all types of computer systems.

As great as the number of available interfaces may be, the availability of software packages is even greater. Thus, most functions that can be done via MIDI have a software package to do it.

First came the sequencers. Based on a hardware device that simply recorded and replayed MIDI data, the software sequencer allowed the computer to record, store, replay, and edit MIDI data into "songs." Though the first sequencers were somewhat primitive, the packages available today provide very thorough editing capabilities as well as intricate synchronization methods, such as MIDI Time Code ("MTC") and SMPTE.

Various software programs, such as patch editors and librarians, are also available for computers. These programs allow the user to edit sounds away from the synthesizer, often in a much friendlier environment than what the synthesizer interface offers. The more advanced librarians permit groups or banks of sounds to be edited, stored on disk, or moved back and forth from the synthesizer's memory. The advanced librarians also allow for rearranging sounds within banks or groups of banks for customized libraries. These programs are generally small and can be incorporated into some sequencing packages for ease of use. On the other hand, each synthesizer requires a different editor/librarian because internal data formats are unique for each synthesizer. Some software packages offer editor groups for a specific manufacturer's line, as some of the internal data structure may be similar between the units.

Computers may also be formed into or be a portion of a MIDI Chain. Basically, the computer functions the same as any other unit in a MIDI chain or loop. Most interfaces have the same three ports as other MIDI devices. The computer's main job in a chain, though, would be as a MIDI data driver, meaning it would supply the MIDI data for the rest of the chain.

This conventional implementation of MIDI channels is generally effective. The computer can send data out on all 16 MIDI channels simultaneously. For example, sixteen MIDI devices, each set up for a different MIDI channel, could be connected to the computer. Each unit could be playing a separate line in a song from the sequencer, creating an electronic orchestra. This implementation is being used more and more in today's music environments, such as in a recording studio, major orchestras, opera, and film scoring.

Also, although not shown, some conventional implementations of tone generators may utilize a standard 88 note 12 tone per octave musical piano keyboard comprising white keys of about one inch (1") in width, and black keys in-between most of the white keys as is known in the art of approximately one-half inch (½") in width.

However, a conventional keyboard does not provide for a smooth transition from note to note in the manner of sliding a finger on a violin string. Also, if additional keys were added to a conventional keyboard it would be physically difficult to utilize in an efficient manner, and thus would inhibit and change the creative input and likely ability to generate what a user wants in a tone generation and control.

Further, a conventional keyboard has a natural or design bias. For example, the arrangement of the keys prefers or most easily is arranged for a certain key, e.g. the key of C. Also, the conventional keyboard utilizes a number of keys that are directly related to the range of the instrument or tone generation, where, for example, conventional 12 tone keyboards are approximately seven octaves. Further, a condensed tonal array may negate the clarity of the conventional sharp-flat system, and limit range. Thus, there are problems both with the input devices utilized with MIDI, as well as problems with other portions of the conventional solutions utilizing the MIDI system.

Further, sometimes problems to the above conventional solutions occur wherein the user may be prevented from more fully utilizing, mastering or fully exploiting the MIDI system. Both these and other problems may arise when using any of the conventional solutions illustrated above for musical control. For example, the conventional MIDI devices have various problems when changing timbre and voice. These conventional solutions also tend to be distracting, impracticable, and problematic from the standpoint that polyphonic pitch slides are not individually controllable, as compared to conventional acoustic devices. This is because the conventional MIDI changes occur as a block function, i.e., they are a function of all notes and are not individually controllable. Also, they require the unwieldy problem of an external controller, e.g., a joystick or a foot pedal.

Although there are some conventional electronic sliding tone controllers for music production, there are inherent complications and thus unsatisfactory results in attempting to achieve polyphony within the existing conventional solutions. For example, for reasons of tone separation and data control, it is difficult to design polyphony into such a device, and thus the results are unsatisfactory. However, some of these problems may sometimes be partially solved by utilizing a MIDI environment. By utilizing the MIDI environment, the problem of note separation can sometimes be overcome, but with other problems and limitations encountered, for example, in that the problem of data control, i.e., channeling a tone selection to a proper frequency base, still remains.

As recited above, and whether in a MIDI environment or not, problems of data control include, for example, a single note modification of a sliding tone chord. Moreover, even in a MIDI environment, problems of data control include, for example, a limitation in range (e.g., the maximum number of tones available per channel). Also, additional exemplary problems of data control include, but are not limited to, proper scalar timbre, which is also a problem in analog sliding tone controllers.

These prior art modifications attempted to partially satisfy the necessity for a greater tonal expression, but they are still not fluidly available to an individual, for example, in performance situations. Moreover, the deportment of the prior art reflects its own limited controllability and thus its inability to satisfy expression.

Thus, what is needed is a system, method, and apparatus that provides an ability to utilize improved audio tone control and generation. What is also needed is a system, method, and apparatus that provides an improved audio tone control and generation, that may be utilized anywhere in the world. Also, what is needed is a system, method, and apparatus that provides for an improved data control and generation. Finally, what is needed is a system, method and apparatus that provides for an improved data flow and interpretation in a broadly expandable manner.

SUMMARY OF THE DISCLOSURE

Embodiments of the present invention are best understood by examining the detailed description and the appended claims with reference to the drawings. However, a brief summary of the disclosure follows.

Briefly described, an embodiment of the present invention comprises a system, method, and apparatus that provides for an improved audio tone control and generation. More specifically, embodiments of the invention relate to systems, methods, and apparatuses for an electronically improved audio tone control and generation that is adaptable for utilization in cooperation with a MIDI type device and/or software. Further, embodiments of the present invention may also be utilized with the World Wide Web. For example, a video feedback may be utilized with the World Wide Web to control data and/or games.

An exemplary embodiment of the present invention comprises a controller for providing an audio tone control and generation. This controller further comprises an input device and a processor device for utilization in an electronically improved audio tone control and generation. In this exemplary embodiment, the controller is suitable for MIDI and other internally installed musical sound generating devices.

Further, in other alternate exemplary embodiments, a number of chaotic source data may be input and interpreted by a data controller portion of the processor device.

In a business method embodiment of the present invention, the user may alternatively pay, for example, a monthly fee for the utilization of a tone control and generation service. Alternatively, the user may pay a per-session fee, or even a fee based upon the data size and/or the amount of data processing of the service, the cost of the product or a percentage of the cost of the product, or some licensing or other arrangement, such as a per transaction cost or any other allocation of charge the user may so desire and/or the provider may wish to provide.

Other arrangements and modifications will be understood by examining the detailed description and the appended claims with reference to the drawings.

BRIEF DESCRIPTION OF THE DRAWINGS

Embodiments of the present invention are described in detail herein with reference to the drawings in which:

FIG. 6 illustrates an exemplary data generation and control portion of an improved audio tone control and generation system, method and device, in accordance with the principles of an embodiment of the present invention;

FIG. 7 illustrates an exemplary alternate embodiment that includes an exemplary modification for an exemplary touch sensitive portion of an improved audio tone control and generation system, method and device, in accordance with the principles of an embodiment of the present invention.

FIG. 14 illustrates an exemplary alternate embodiment relating to FIG. 3, of an exemplary portion of an improved audio tone control and generation system, method and device, in accordance with the principles of an embodiment of the present invention.

The accompanying drawings, wherein like numerals denote like elements, are incorporated into and constitute a part of the specification, and illustrate presently preferred exemplary embodiments of the invention. However, it is understood that the drawings are for the purpose of illustration only, and are not intended as a definition of the limits of the invention. Thus, the drawings, together with the general description given above, the detailed description of the preferred embodiments given below, and with the appended claims, serve to explain the principles of the invention.

DETAILED DESCRIPTION OF THE PREFERRED EMBODIMENT

An exemplary embodiment of the present invention comprises a controller for providing an audio tone control and generation. This controller further comprises an input device illustrated in FIG. 2A, and a processor device illustrated in FIG. 3, for utilization in an electronically improved audio tone control and generation. In this exemplary embodiment, the controller is suitable for MIDI and other internally installed musical sound generating devices.

Figure 3:
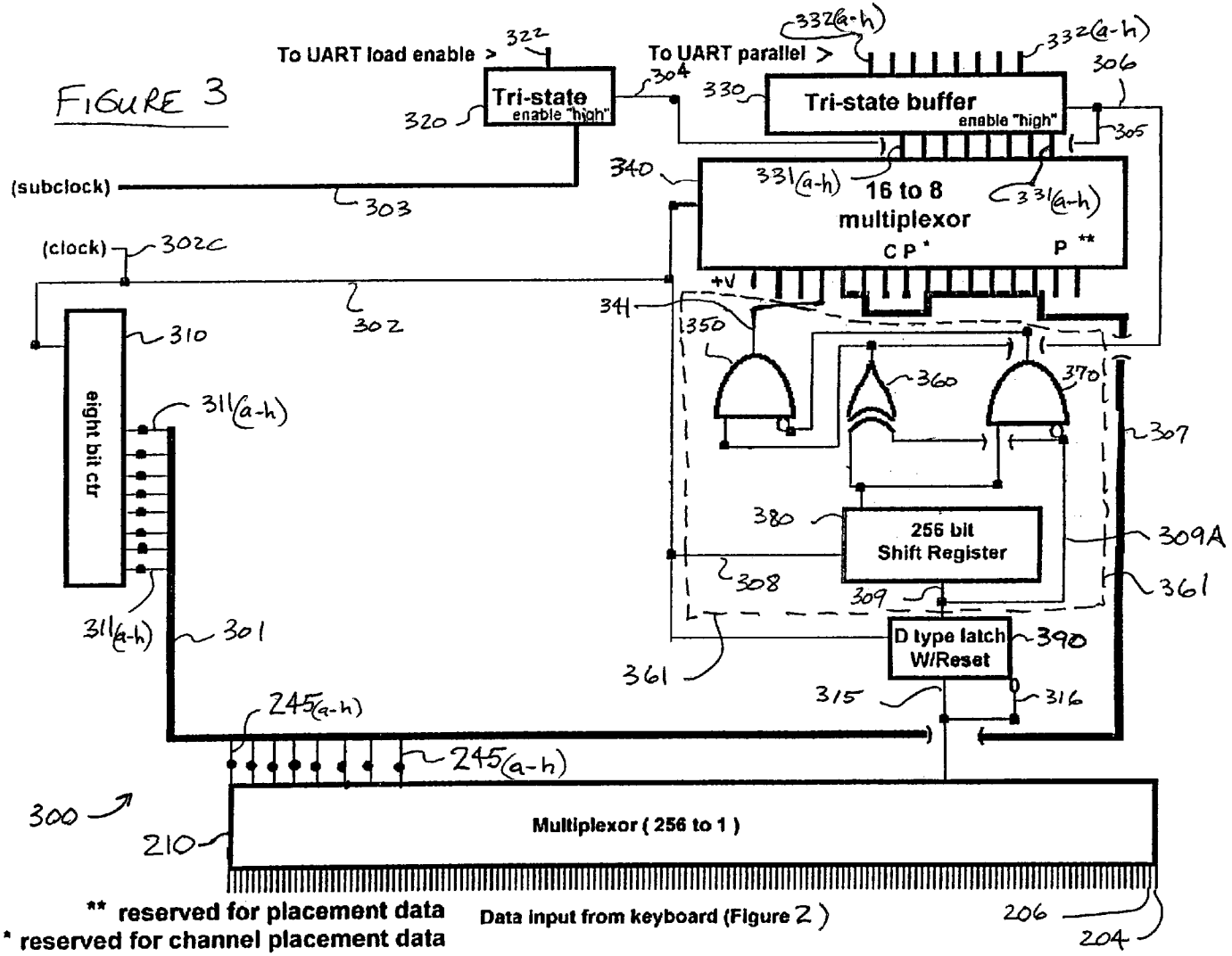
FIG. 3 illustrates an exemplary portion of an exemplary data control portion of an improved audio tone control and generation system, method and device, in accordance with the principles of an embodiment of the present invention.
Figure 4:
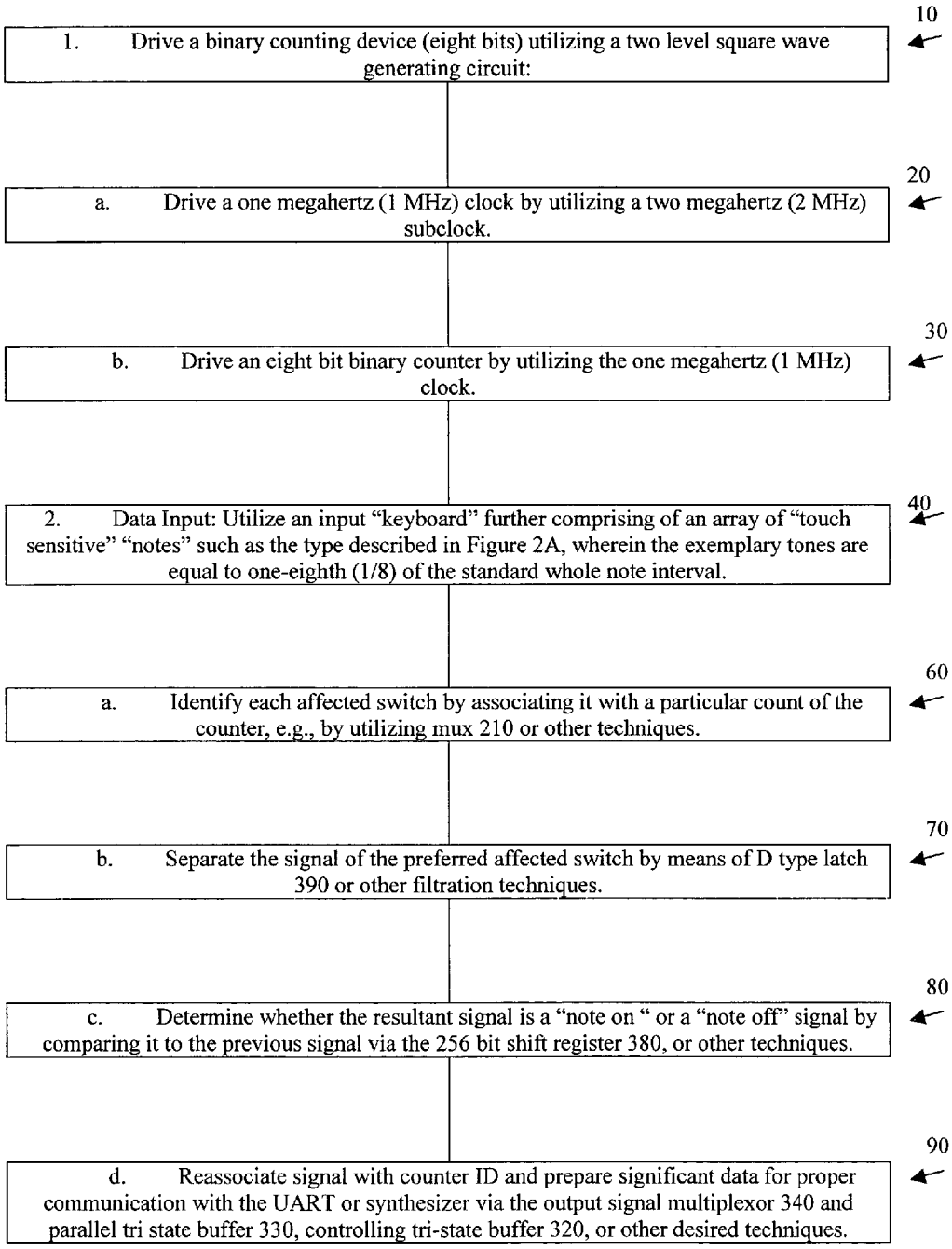
FIG. 4 illustrates an exemplary portion of an improved audio tone control and generation system, method and device, in accordance with the principles of an embodiment of the present invention.
Figure 5:
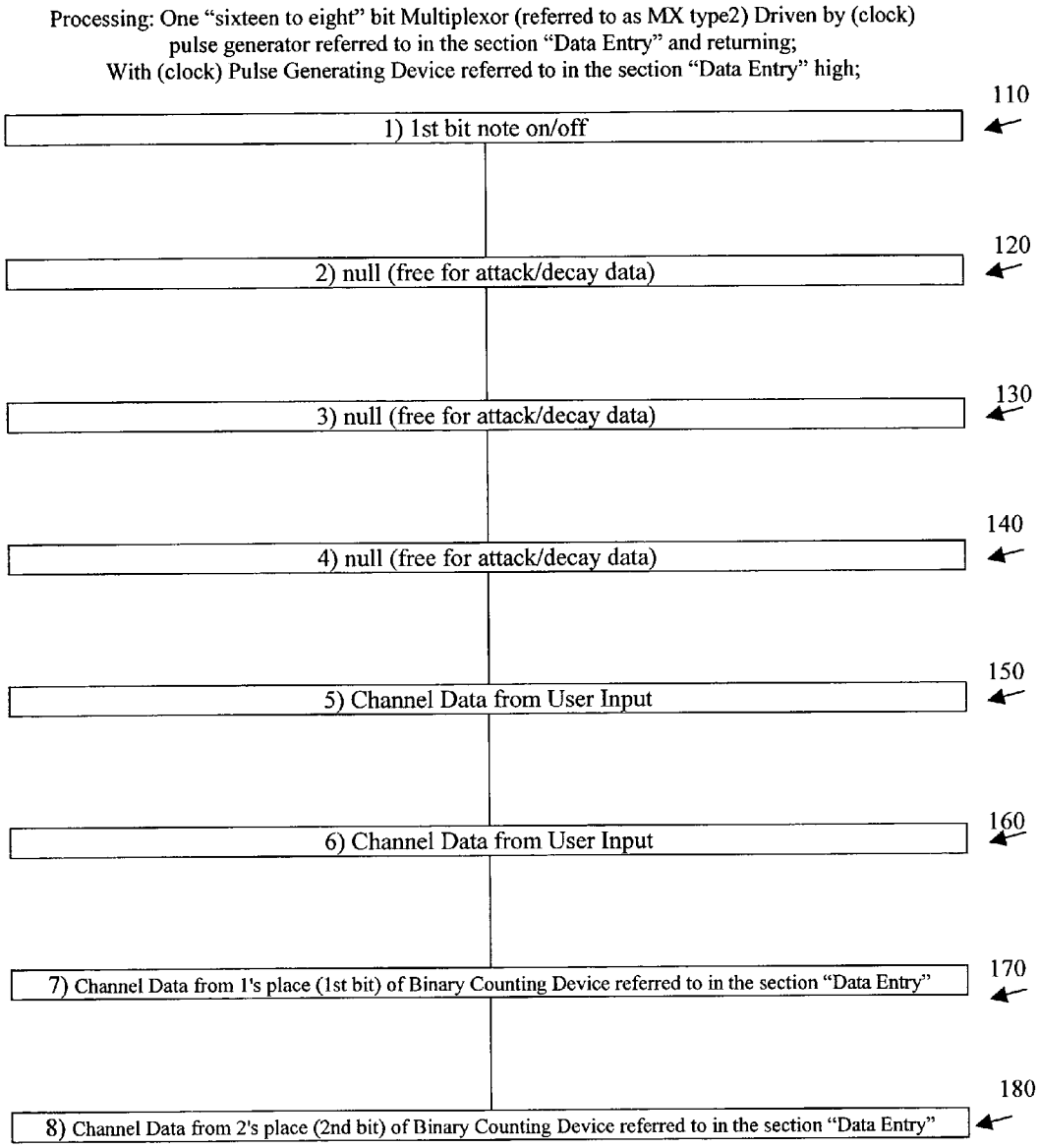
FIG. 5 illustrates an exemplary portion of an improved audio tone control and generation system, method and device, in accordance with the principles of an embodiment of the present invention.

An embodiment of the present invention is illustrated utilizing functional flow charts as shown in FIGS. 4, 5, and 6. FIGS. 4, 5, and 6 illustrate algorithms that may be utilized by at least a portion of the processing portion embodiment illustrated in FIG. 3.

Figure 1:
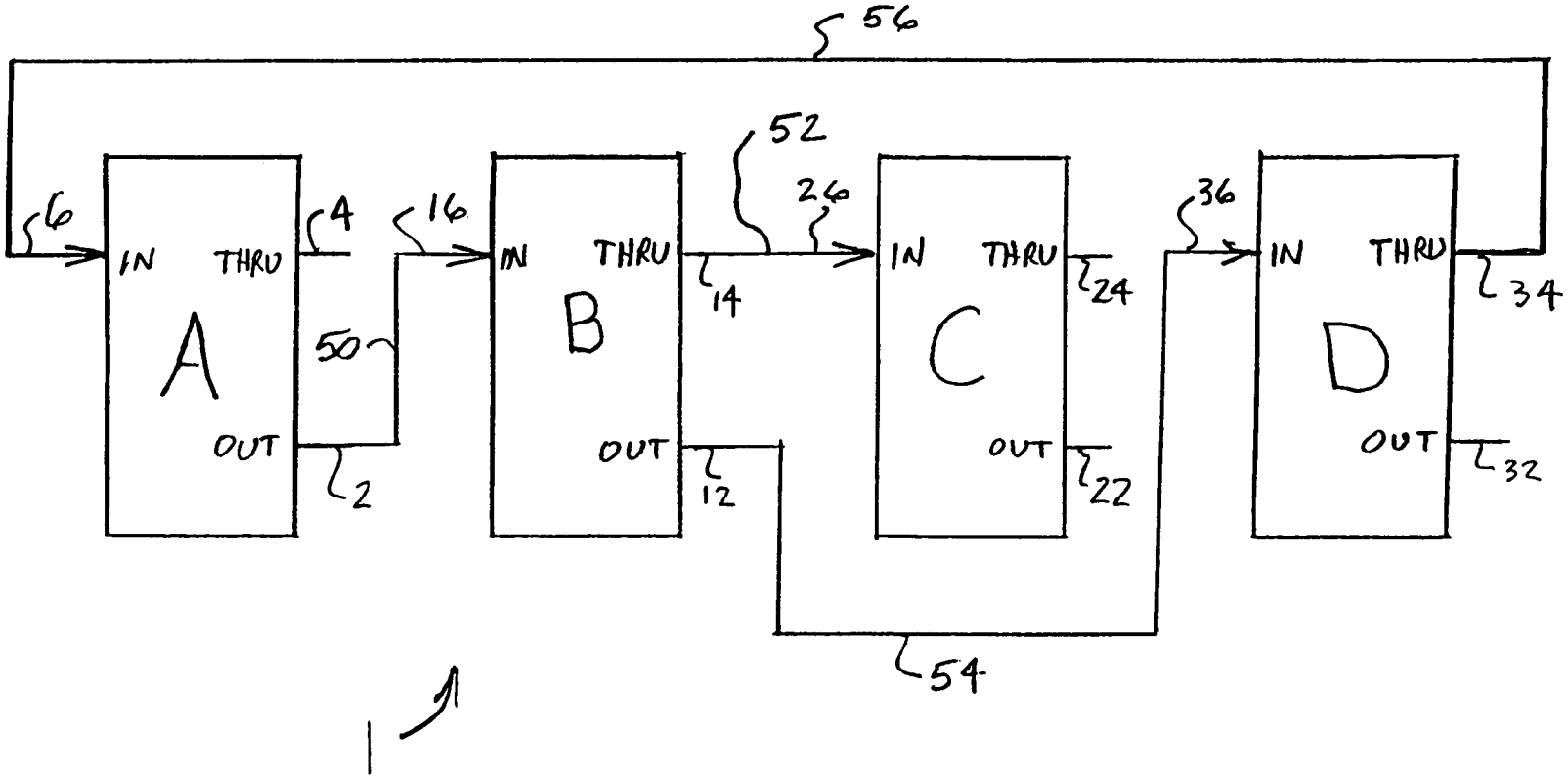
PRIOR ART FIGURE 1
FIG. 1 illustrates an exemplary utilization of a portion of a conventional audio tone control and generation system, method and device.
Figure 2A:
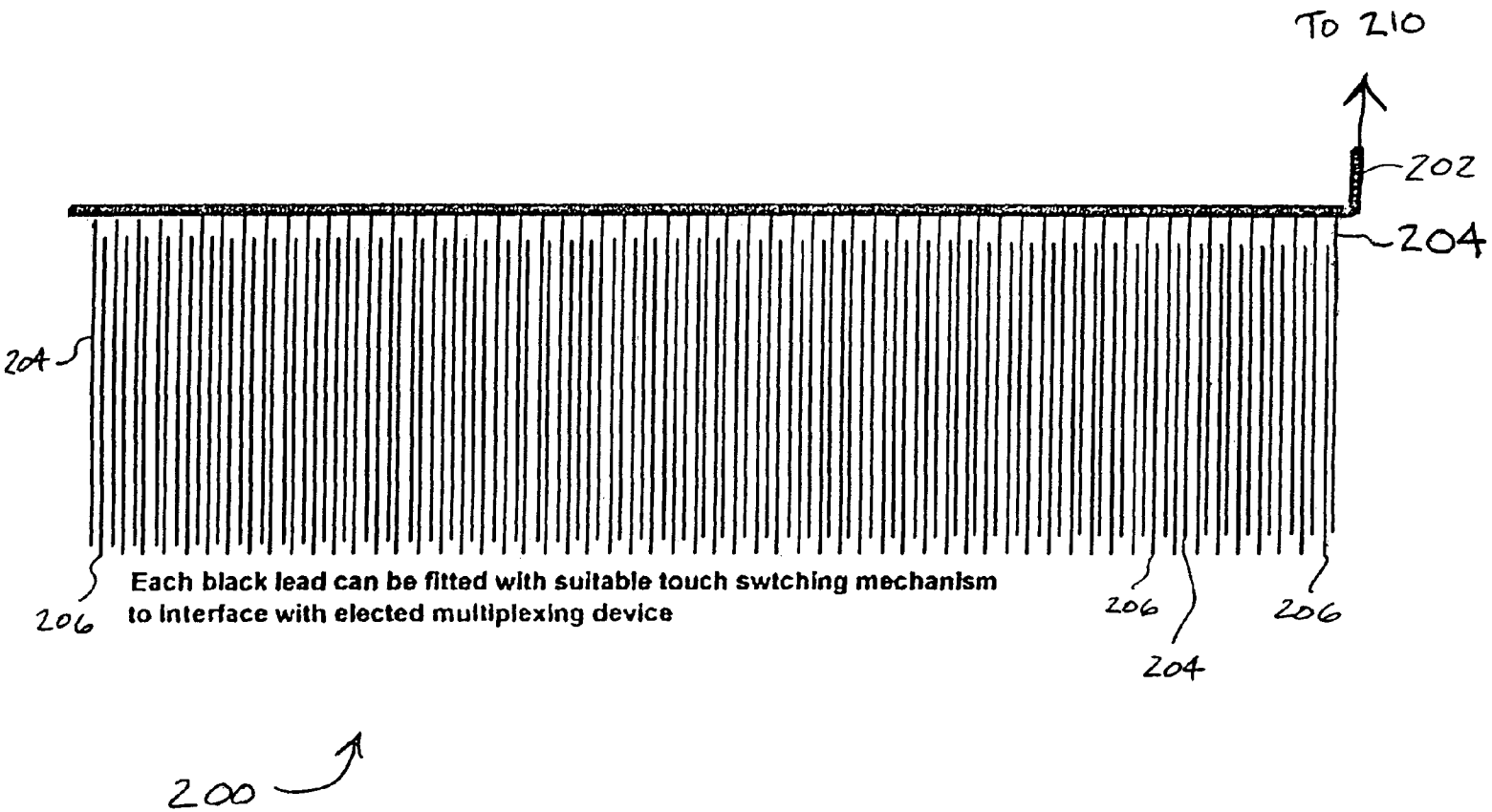
FIG. 2A illustrates an exemplary portion of an exemplary data entry portion of an exemplary user input embodiment of an improved audio tone control and generation system, method and device, in accordance with the principles of an embodiment of the present invention.
Figure 8:
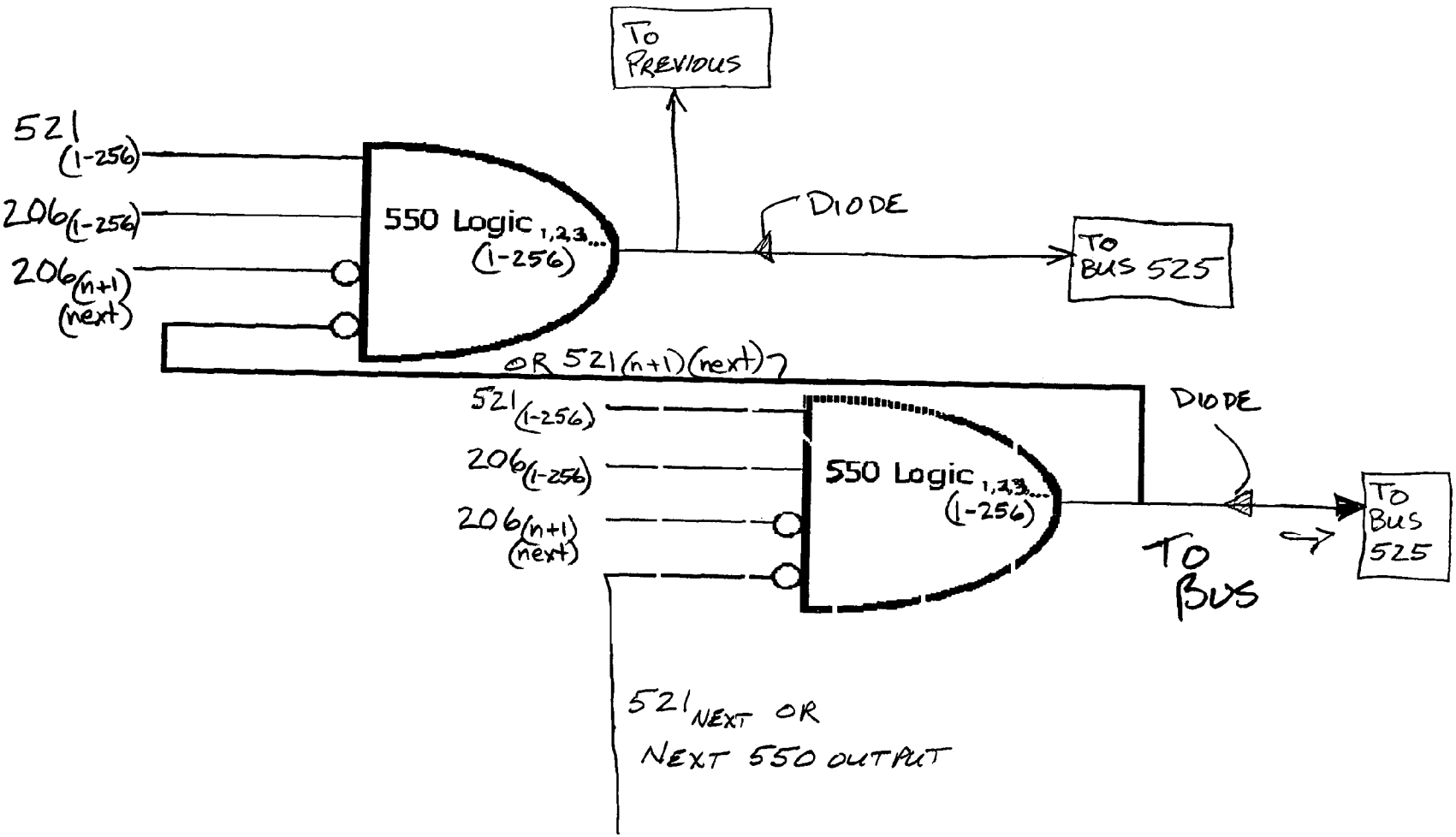
FIG. 8 illustrates an exemplary alternate embodiment relating to FIG. 3, of an exemplary portion of an improved audio tone control and generation system, method and device, in accordance with the principles of an embodiment of the present invention.
Figure 13:
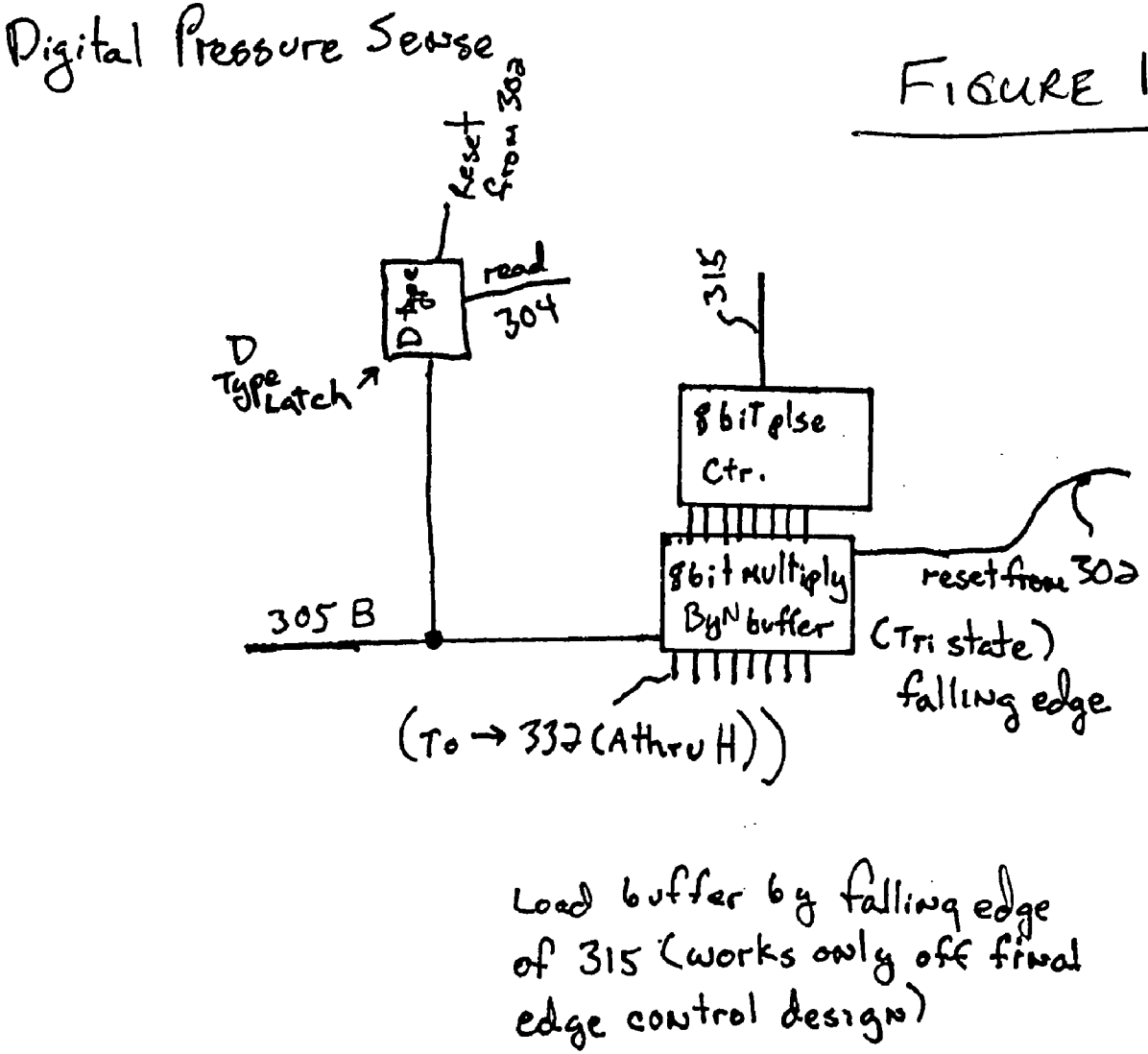
FIG. 13 illustrates an exemplary alternate embodiment relating to FIG. 3, of an exemplary portion of an improved audio tone control and generation system, method and device, in accordance with the principles of an embodiment of the present invention.

FIGS. 7, 13, and 14 illustrate exemplary alternate embodiments that include exemplary modifications for an exemplary touch sensitive portion of the input device of FIG. 2A, and FIG. 8 illustrates an exemplary alternate embodiment relating to the processing portion shown in FIG. 3.

FIGS. 8–12 illustrate other exemplary alternate embodiments that include exemplary modifications of portions of the embodiments illustrated in FIGS. 2A and 3.

As illustrated in FIGS. 2A and 3, this exemplary embodiment comprises a controller device or "Panarray." Generally, some of the various embodiments of the present invention that may comprise a "Panarray" device as described herein, take a more wholistic approach to the linear layout of musical control and generation. This wholistic approach is embodied by preferably removing most of the bias of the tonic foundations, although, if desired by the user, the temper of scale may still reflect a relationship to a 440 HZ "A" tone, i.e., concert pitch, of an altered "A" tone pitch, such as a 438 Hz "A" tone pitch, or any other pitch frequency desired by the user. In preferred embodiments of the present invention, the removal of mechanical switches, e.g., piano keys, allows a user to achieve a subtler transition between applications, and thus a more cohesive tonal performance. The cumulative effect of so many functions, e.g., vibrato, tremolo, and portimento, that may thus be polyphonically available to the user without lifting a hand from a console or finding a pedal with a foot, may be both physically and emotionally liberating for the user, and may also allow for a more fluid or simultaneous utilization of other effects available to synthesis. Also, another important feature of various embodiments of the present invention comprises allowing the user the maintenance of context inherent in the application of these functions, which may be an irresistible attraction to many virtuosi users of various embodiments of the present invention.

More specifically, and as illustrated in FIG. 2A, the exemplary embodiment includes an input device portion. However, unlike a conventional musical keyboard, the input device portion of the embodiment illustrated in FIG. 2A is instead a set of switches further comprised of switch portions, or preferably a multiple switch such as a switch array. Unlike conventional keyboards that are designed for individual note generation, this exemplary embodiment instead includes a switch array that preferably works together. For example, the switches may work together to provide intercession and intervention between the user and the processor portion illustrated in FIG. 3 so as to provide an output for a tone generation in an interpretational manner.

The user may utilize the set of switches in FIG. 2A, combined with the processor portion of FIG. 3, so as to provide an output to, e.g., a MIDI device to complete a tone generation. It will be understood by one skilled in the art that by utilizing embodiments of this invention, a wider and more full spectrum of tones may be achieved than were previously possible by utilizing a conventional MIDI device.

In the embodiment shown in FIG. 2A, the set of switches essentially function as individual arguments and messages within a system, wherein the system utilizes the processor portion of FIG. 3 to judge and choose which switch arguments or messages to send, so that the system preferably performs an arbitration of the arguments and messages and sends the appropriate output for utilization in tone generation.

Exemplary embodiments of the present invention utilize the processor portion of FIG. 3 to provide the ability for continued processing and continued judgment of each switch input after the switch activation (e.g., the initial data entry or tone selections) of FIG. 2A occurs. Further, the processor portion of FIG. 3 provides the ability of various exemplary embodiments of the present invention to enhance and provide a finer tonal range and more tonal intervals over same number of octaves than would be available with a conventional MIDI tone generation. Also, as shown in FIGS. 2A–3, embodiments provide for this enhanced type of data handling and processing as compared to that possible within a conventional MIDI. Thus, embodiments of the present invention provide a user with a system, method, and apparatus for an improved tonal generation, in contrast to that achievable with a conventional MIDI, in the direction of emulation of analog control over synthetic music properties.

In a preferred controller embodiment of the present invention, the controller embodiment does not actually generate tones directly. Instead, preferred embodiments of the present invention comprise a controller that controls, via MIDI, the tones generated by a MIDI compatible synthesizer. Various alternate embodiments may be configured so as to utilize, e.g., either a MIDI compatible synthesizer or an internal synthesizer, and these embodiments of the present invention may be utilized to provide for a range of tonal dynamics previously considered essentially unattainable in a musical instrument. Although some parts of this range may sometimes be conventionally attainable in present acoustic instruments and some other parts of the range sometimes obtainable in MIDI, the conventional devices do not offer all of the range attributes, nor the artistic control that are available through the various alternate embodiments of the present invention. Thus, for example, preferred embodiments of the present invention essentially provide for an improved artistic control. For example, some embodiments of the present invention also incorporate the best features of the standard twelve tone keyboard and the fretless freedom of a Violin family member.

In a preferred exemplary embodiment of the present invention a "Panarray" system, method, apparatus, and/or algorithm is utilized as a controller suitable for MIDI or other internally installed musical sound generating devices or systems. The Panarray comprises the controller as illustrated in various alternate embodiments as illustrated in FIGS. 2A through 14. In the preferred embodiments of the present invention, the Panarray comprises the set of input switches of FIG. 2A, combined with the processor portion of FIG. 3, that provides an output to, e.g., a MIDI device to complete a tone generation.

In other various exemplary embodiments of the present invention, alternate utilizations for the Panarray are also possible. In one example, embodiments of the present invention may comprise a multifunctional data controller for real time influence of multi-object data modification. Further, in other alternate exemplary embodiments, a number of chaotic source data may be input and interpreted by a data controller portion of the processor device.

In various other alternate embodiments, the operation of the Panarray may include the introduction of one or more notes via a touch sensitive linear keyboard-like assembly, or "keyboard array." In these exemplary embodiments, the Panarray may interpret the desired notes to result in tone generation (e.g., to "play") by comparing the input of previous cyclical readings of at least one of the "note(s) on" and the "note(s) not on (or note(s) off)" received from the keyboard or switch array. Thus, for example, each individual finger may either intentionally or inadvertently select one or more than one switch from the keyboard array, and depending upon the Panarray interpretation, may or may not result in tone generations based upon these selections. In an alternate embodiment, one or more touch sensitive linear keyboard-like assembly switches may instead be replaced with one or more other types of selectors, or actuators or switches. Also, the notes may themselves comprise, e.g., selectors, actuators or switches.

In one exemplary embodiment, the separate notes desired by the player may be discerned by the spaces between the "switches on" that may contain one or more "switch(es) not on" within each cycle. The note intended may be taken as the first, last, middle, and/or any reliable constant relative to the limits expressed within each group of "switches on" that are not separated by a "switch(s) not on" as illustrated in FIG. 3. The beginning and end of each note, or notes, e.g., the period of play, may be discerned by its respective presence or lack of presence within the previous cycle as compared by, e.g., a decoding logic 361, wherein this decoding logic 361 may comprise a phase locked loop operation as illustrated in this exemplary embodiment, that may also preferably utilize, e.g., a shift register or other such memory device. The phase locked loop operation may be implemented with, e.g., a device or an algorithm or other combination of software and hardware.

In one alternate embodiment, conventional MIDI synthesis techniques and equipment may be utilized with the Panarray to generate tones. For example, one of the problems inherent in sliding tone control, that is not satisfactory in conventional systems, is the issue of scale temperament. Temperament varies the frequencies of notes within a scale to provide a softer, sweeter or more melodic character that makes the sound more musical. Many modern conventional MIDI synthesizers have pre-existing controls for setting scale temperament. By utilizing this existing MIDI technology with the preferred embodiments of the present invention, the user is afforded the opportunity of taking advantage of these MIDI options so as to achieve a greater artistic control over the generation of tones. Thus, in a preferred embodiment, an existing MIDI synthesizer may be adapted to accept and utilize a Panarray.

In an alternate embodiment, the Panarray can be plugged into the "MIDI in" port of a MIDI synthesizer, in essentially a manner analogous to how a user would plug in a conventional MIDI controller. However, one difference is in the internal settings of the MIDI synthesizer. First, in an exemplary embodiment, four consecutive receiving channels are set to receive the channels transmitted by the Panarray. For preferred sliding tone emulation, three voices are detuned in sequence by increments of 25% of the half tone step set by the twelve-tone system. For a preferred subtly quiet slide embodiment, these voices should be identical in all other ways, and the attack and decay of each should be gradual. Of course, artistic control will be left to the user artist, but this method will provide for a preferred emulation of a slide embodiment.

Although not shown, various alternate embodiments may also be utilized with the Panarray controller. In some exemplary alternate embodiments, the Panarray may be utilized to serve as a multi-object linear data controller in approximately real time applications. An exemplary arrangement includes a joystick that operates radially in game applications. Further, many functions of the Panarray may be utilized in cooperation with existing controllers, e.g., a computer "mouse" and "keyboard" and even another Panarray, if desired, so as to allow the user to control several objects at a time. These Panarray exemplary embodiments may provide a function that is advantageous, e.g., in the real time interpretation, manipulation and creation of time based graphic expressions.

There are other exemplary beneficial embodiments of the Panarray of the present invention. For example, the conventional MIDI system has an inherent limitation of 128 increments per channel. This limitation may be overcome by the Panarray's multi-channel function. For example, the slide quality, range, or both may be increased by increasing the amount of notes per musical halftone, total notes on the device, or, in other embodiments, some alteration of both. For example, the user may increase the number of notes per half tone and the range of the device. These alternate embodiments can be achieved by increasing the number of MIDI channels the Panarray utilizes.

In an exemplary alternate embodiment, in order to increase the number of notes per half tone, the embodiment illustrated in FIGS. 2A and 3 would only need to switch to a five position binary counter (not shown) as a channel reference. This alternate embodiment will increase the half tone density to five tones, provided that the five channels occur within the MIDI limit of sixteen channels. Also, the synthesizer would have to accept five channels that are detuned in this alternate embodiment by 20%. This allows for a greater density between notes. However, this alternate embodiment may also cause the loss of some of the total range of the Panarray device or make necessary an increase in input.

However, total range can be increased in yet another alternate embodiment by further increasing to sixteen channels and utilizing the entire available MIDI spectrum. Here, the number of notes per half tone can be increased as described above, until and including the limits of the synthesizer and the 16-channel limit of the MIDI format itself are reached. As the MIDI devices improve other alternate embodiments of the present invention may be realized by analogous extrapolations of the above alternate embodiments.

In an alternate exemplary embodiment of the present invention, by rotating data input over four MIDI channels essentially simultaneously, a maximum note capacity may be quadrupled. Further, the minimum interval between notes is now one eighth (1/8) of a tone, i.e., by the standard of western music. It is also understood in some preferred embodiments of the present invention that a half tone (1/2 tone) is considered a step, i.e., a chromatic step, between two notes. By assigning four identical "voices" to these channels and then de-tuning each by one fourth (1/4) the standard distance between the notes described by MIDI, the interval between notes may be reduced. In an alternate embodiment, the envelope of each tone may be adjusted to allow, e.g., a relatively negligible, i.e., ignorable, and therefore essentially a subtle transition between tones. Thus, a sliding effect may be achieved. In other alternate embodiments, improved sliding effects may also be achieved by decreasing the interval size between notes, e.g., to one sixteenth (1/16) or one thirty-second (1/32), and may be any increment the user desires, e.g., one twenty-third (1/23) or one fiftieth (1/50), or even smaller increments. Thus, this sliding effect is beneficial and desirable because it offers an essentially real time creative tone control unavailable in music presently.

In an alternate exemplary embodiments of the present invention, a MIDI synthesizer utilized with this device is extensively polyphonic, and multi-tymbral by at least the number of voices called for, or preferred by the user, in the channel rotation. In the context of these exemplary embodiments, the term "polyphonic" represents more than one (1) note at a time, and the term "multi-tymbral" essentially represents the ability to play more than one (1) voice at a time. Also, one reason for utilizing this exemplary embodiment with a relatively extensively polyphonic MIDI synthesizer is because slide quality increases with polyphony. This is also because in an alternate exemplary embodiment, that may also be considered a preferably minimal embodiment, the multi-tymbrality needed is four (4) times the normal load.

In alternate exemplary embodiments of the present invention, more channels may be utilized. However, it is understood for the purposes of clarity of this exemplary description that four channels are utilized. For example, in alternate exemplary embodiments, the number of channels may, e.g., comprise 8, 16, 32, 64, and 128 channels, and so on. Also, in some other alternate embodiments, the first and last message of each sliding event can be separated for the purposes of touch and speed sensitive data considerations, e.g., by separating all notes not immediately following or preceding another, and then applying the desired logical ramifications. This separation of the first and last message of each event may be desired and be beneficial because it allows for staccato and rests by suppressing pressure changes within it. These logical ramifications comprise, for example, the steps of sculpting (e.g., via MIDI pressure sense) the attack of a slide without altering the purity and subtlety within the tonal slide. These exemplary configurations have been chosen to be described herein for their relatively descriptive simplicity regarding the innovations specific to embodiments of the present invention comprising a Panarray. In yet other alternate embodiments, a relatively more complex variety of embodiments may be utilized, such as alternative real time controls, e.g., a joystick and/or a control pedal.

In a preferred exemplary embodiment of the present invention, data can be processed simultaneously over small groups, or alternatively as a whole. FIGS. 2A and 3 illustrate an exemplary embodiment, as shown, utilizing a 256 to 1 multiplexor (also known as a single Mx type1) configuration. These configurations may be altered, depending upon the speed and capacity of available technology and desires of the user. For example, a single two hundred fifty six bit to one (256×1) multiplexor as shown in the exemplary embodiment of FIG. 3 may be utilized. Although not shown, in an exemplary alternative embodiment, e.g., eight (8) simultaneous thirty-two bit to one (32×1) multiplexors can be utilized instead of the single (256×1) multiplexor to access raw data. The associated benefits are relative to the limitations of the supporting hardware. These associated benefits may include, but are not limited to, greater speed and finer pitch separation. This, in turn, provides for greater slide emulation.

In these preferred exemplary embodiments of the present invention comprising the Panarray, the Panarray is preferably combining de-tuned MIDI, or MIDI style, channeled data into a single "voice" (or multiple voices, as desired by the user) for the purposes of emulating and controlling polyphonic sliding tone generation. This is preferred because it supports and facilitates the clarity of pitch selection.

FIG. 2A illustrates an exemplary embodiment of the present invention that includes a section of a switch array 200 that is preferable touch sensitive, and is also preferably intended for manually controlling the Panarray for the purpose of generating music. FIG. 2A illustrates a plurality of first switch portions 204 which are preferably a plurality of voltage access extensions, i.e., switch sensors, and that are preferably electrically hot or capacitive and connected to the voltage bus 202. FIG. 2A also illustrates a plurality of second switch portions 206, that may comprise electrical ground access connections, i.e. base connections in this exemplary embodiment, and that may alternately include a plurality of provisional continuum elements, for the touch sensitive array. In FIG. 2A, each second switch portion 206 may preferably represent an individually and electrically isolated ground access connection that is separate and distinct for each second switch portion 206. When, for example, a first and second switch portion 204, 206 are breached by a touch, a current is then induced in at least one of a plurality of second switch portions 206, which are preferably a plurality of individual ground access connections, which in turn triggers an input to the primary multiplexor 210. In a preferred embodiment, each second switch portion 206 is equivalent to a separate temporary conditional switch. It is also understood by one skilled in the art that in the exemplary embodiment of FIG. 2A, that for each of the plurality of first switch portions 204 there is a corresponding second switch portion 206, and that the first switch portions 204 preferably cooperate with the plurality of second switch portions 206, so as to form a corresponding number of strata pairs. However, it is also understood that in various alternate embodiments (not shown) that for any logically assigned or interpreted corresponding strata pair that are formed, for example, by the impetus of touching of that strata pair that comprise at least one specific first switch portion 204 and second switch portion 206, need not be physically co-located next to each other, nor must the plurality of first and second switch portions 204, 206 be equal. However, in the following illustrated embodiments, the first switch portions 204 and second switch portions 206 are physically generally collocated and are preferably equal in number.

It is understood by one skilled in the art that the electrical current sensors, that may also be high impedance and highly biased transistors, are not shown for clarity in FIG. 2A. These current sensors are preferably electrically connected between the switch gaps and a resistive ground access.

It is also understood by one skilled in the art that the second switch portions or ground access connections in FIG. 2A may be eliminated and functionally replaced by the capacitance effect provided by the human body wherein the first and second switch portions 204, 206 are of sufficiently low voltage to allow human body to provide this capacitance effect function.

In FIG. 2A, the plurality of second switch portions 206, or more specifically in this exemplary embodiment, the ground access connections, represent the base or the ground access side of the switch assembly that induces a slight current. In FIG. 2A, a touching of at least one first switch portion 204, that is preferably a hot lead, i.e., the voltage access extension in this exemplary embodiment, and at least one second switch portion 206 that are preferably a second or base lead, i.e., the ground access connection in this exemplary embodiment, triggers an input on the primary multiplexor 210 via these input trigger devices, so as to operate in the manner of switch capacitance-type touch sensitive leads. Thus, by breaching this dielectric with, e.g., a user's finger, the primary multiplexor 210 will be triggered in at least one place, as shown in FIGS. 2A and 3.

More specifically, in a preferred embodiment, at least one simultaneous contact of each of at least one (1) first switch portion 204 and one (1) second switch portion 206 is made. The electrical connection is made by contact preferably with an impetus stimulus. This impetus stimulus may comprise, for example, a human finger, but may alternately comprise other objects, materials, and shapes as desired by the user so as to alter and/or enhance the resulting output.

The embodiment of FIG. 2A illustrates a voltage side bus. This voltage side bus is connected to the primary multiplexor 210 of FIG. 3 via electrical current sensors that are not shown for clarity. Although not shown, these electrical current-side sensors may be connected directly to primary multiplexor 210, and current sensors for each of the first and second switch portions 204, 206 are preferably located at primary multiplexor 210, and where each of these current sensors are preferably either located adjacent to or integrated with primary multiplexor 210.

Alternately, although not shown, instead of the voltage bus 202 of FIG. 2A, a ground side bus may be utilized, where the electrical current switches would then be preferably located between a ground switch assembly and electrical ground (not shown), and would also connect the current switches to the primary multiplexor 210 of FIGS. 2A and 3.

Also, although not shown, as to the non-bus-side portion of the various alternate embodiments of the present invention that are selected or activated by a touch sensitivity, such as a physical contact, the plurality of first and second switch portions, or alternately sensors, may comprise one or more voltage side sensors, or alternately ground side current sensors, as desired. In various alternate embodiments, embodiments that allow for relatively enhanced touch sensitivity are preferred, but these preferred embodiments do not require a specific type of implementation as to how the touch sensitivity is recognized.

Other exemplary alternate embodiments of the switches of FIG. 2A are illustrated in FIGS. 2B, 2C, 2D, and 2E.

Figure 2B:
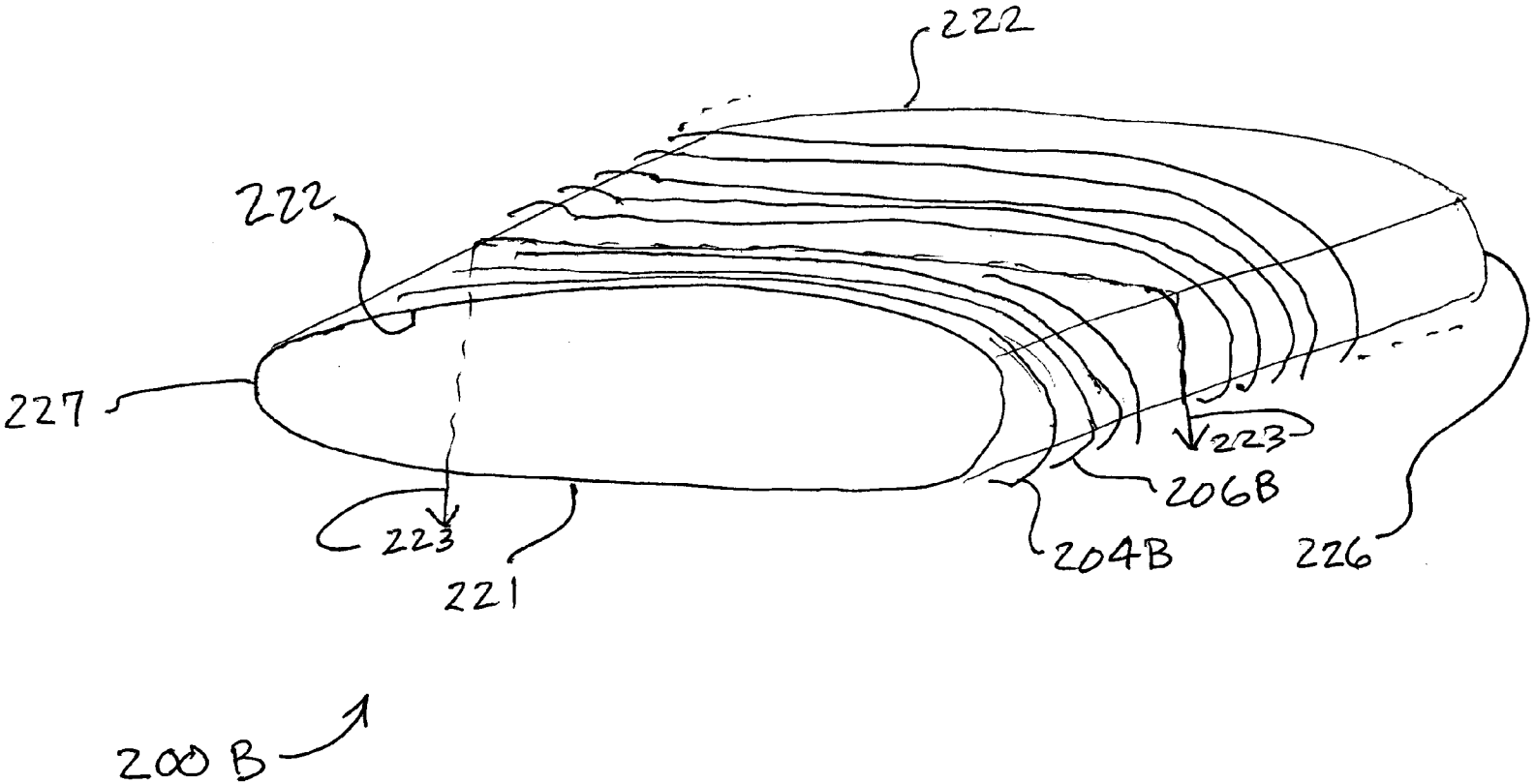
FIG. 2B illustrates an alternate exemplary portion of an exemplary data entry portion of an exemplary user input embodiment of an improved audio tone control and generation system, method and device, in accordance with the principles of an embodiment of the present invention.

For exemplary embodiment of FIG. 2A, the plurality of first and second switch portions 204, 206, that are illustrated as essentially flat switches, are a preferred embodiment. The plurality of first and second switch portions 204, 206 may be pressure sensitive, capacitance sensitive, touch sensitive, or physically actuated, and the like, or a combination of each. However, the plurality of first and second switch portions 204, 206, that each may alternately comprise strata, wherein one of each comprise a strata pair, of FIGS. 2A through 2E, can also be located on the "top" and "bottom" of a switch array, such as illustrated in FIG. 2B, as well as, for example, on any or all sides of a polygonal-like cross sectional switch array (not shown). The plurality of first and second switch portions 204, 206 can be on the top or the bottom of the array, as well as the sides if desired by the user, and are preferably the same electrical strata (and/or strata pair(s)) that are on the top and bottom for each strata.

However, with increases in processing speeds, users may desire to instead utilize an alternate embodiment of non-linear switches, e.g., by utilizing a separated series of different resistors (not shown), however, instead the preferred single impetus per strata pair, the strata pair being a logical set comprising a portion of the plurality of first and second switch portions 204, 206 of this exemplary embodiment of FIGS. 2A through 2E. Other alternate embodiments include but are not limited to utilizing a counter to recognize the resistor or resistors activated, and the depth of activation of each switch, or alternately utilizing a Dec-8 counter or an analog to digital conversion of capacitances for determining which and to what extent each switch has been activated. However, the presently preferred embodiments utilize a linear relationship of the switches so as to form a plurality of strata pair, wherein each half, i.e. one each of a first and second switch portions 204, 206, of the strata pair is physically adjacent to one another. It is also understood by one skilled in the art that each strata pair may be utilized to vary any parameter of the conventional MIDI control bits. For example, variable parameters may include, but are not limited to, volume, "fx" (special sound effects), tone, and any other type of channel data of the instrument type.

Figure 2C:
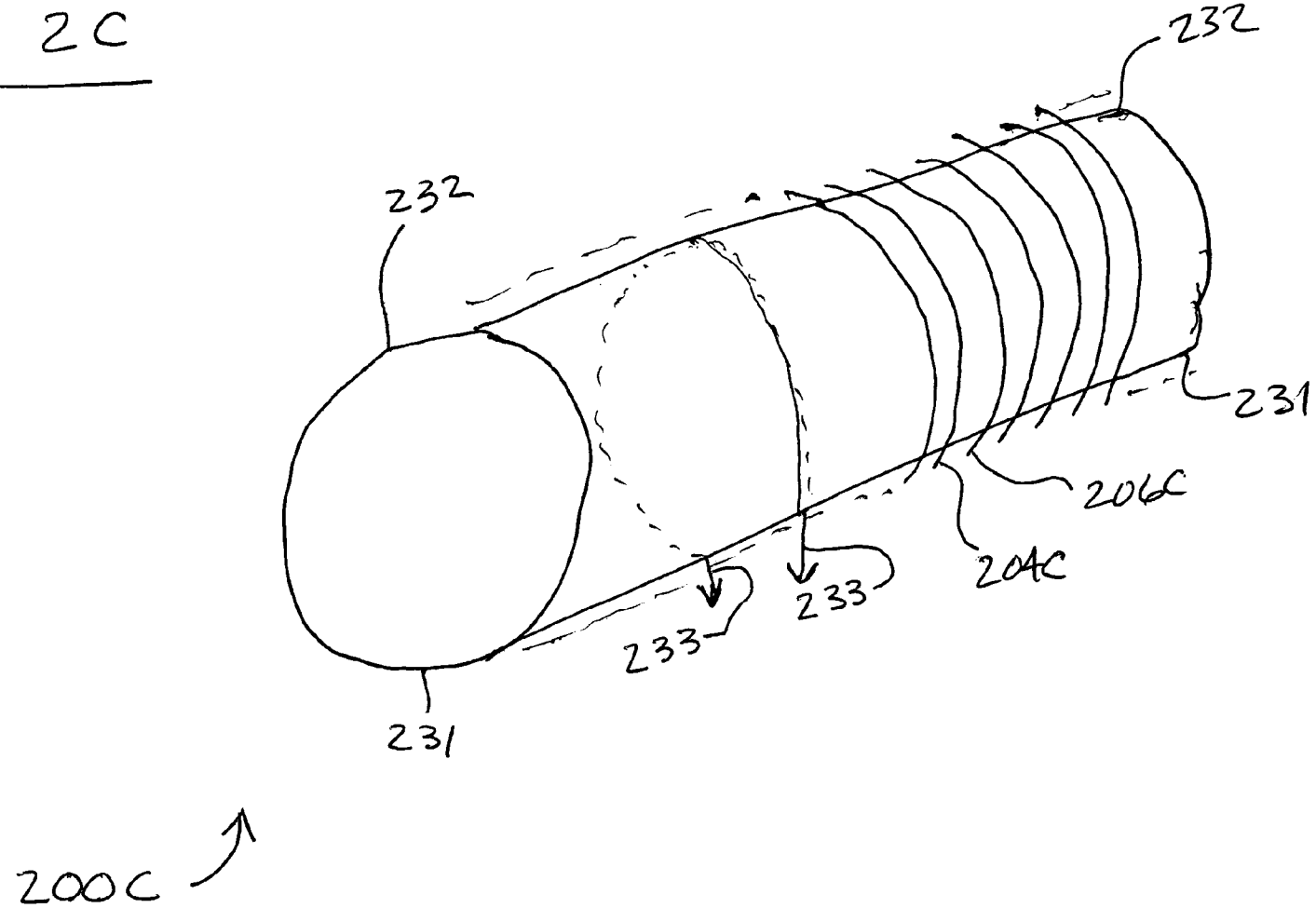
FIG. 2C illustrates an alternate exemplary portion of an exemplary data entry portion of an exemplary user input embodiment of an improved audio tone control and generation system, method and device, in accordance with the principles of an embodiment of the present invention.
Figure 2D:
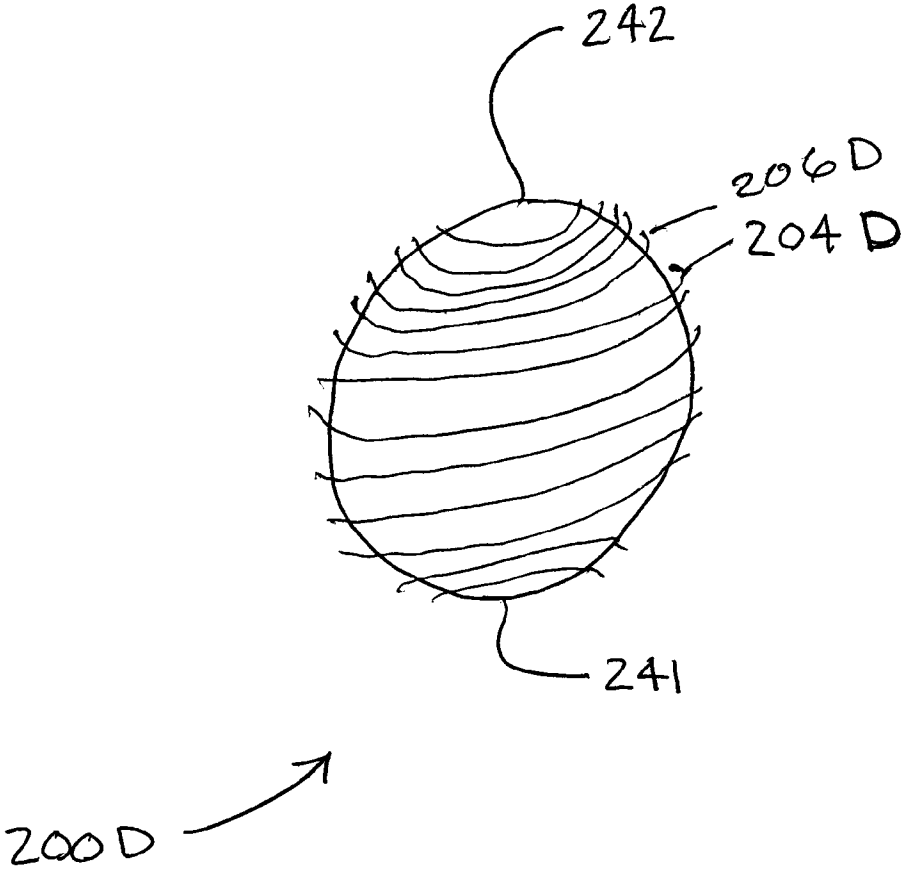
FIG. 2D illustrates an alternate exemplary portion of an exemplary data entry portion of an exemplary user input embodiment of an improved audio tone control and generation system, method and device, in accordance with the principles of an embodiment of the present invention.
Figure 2E:
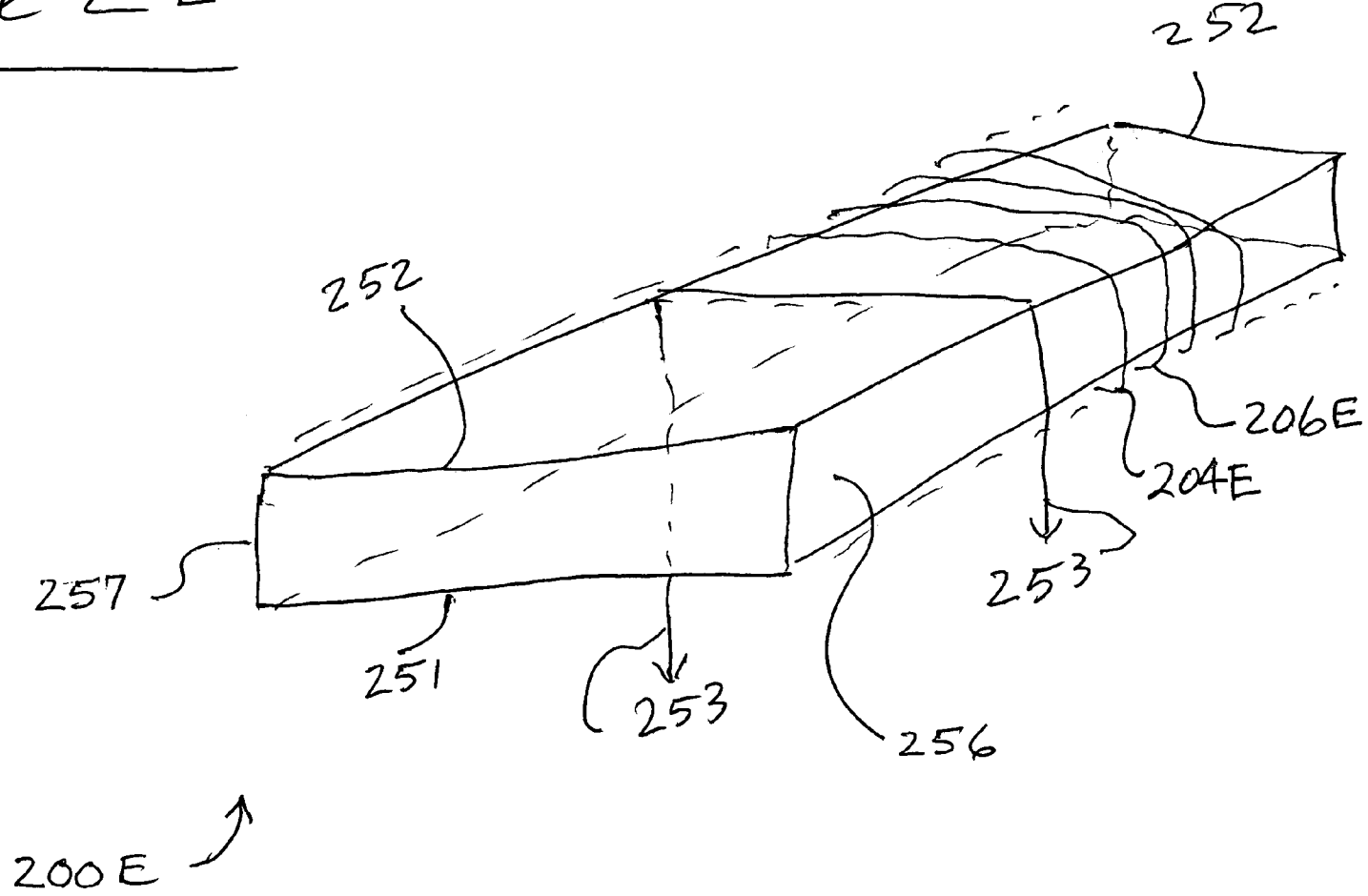
FIG. 2E illustrates an alternate exemplary portion of an exemplary data entry portion of an exemplary user input embodiment of an improved audio tone control and generation system, method and device, in accordance with the principles of an embodiment of the present invention.

As an alternate exemplary embodiment of the impetus device portions, e.g., the impetus device portions that provide for a sensing of a human touching act of FIG. 2A, the approximately elongated oval or "flattened" cross sectional tubular shape impetus device of FIG. 2B illustrates one exemplary alternate embodiment. FIG. 2C illustrates another exemplary alternate impetus device of FIG. 2A with an approximately cylindrical shaped impetus device. FIG. 2D illustrates yet another exemplary alternate impetus device of FIG. 2A as an approximately spherically shaped impetus device, while FIG. 2E illustrates a rectangular shaped embodiment. Other alternate embodiments of the impetus device of FIG. 2A through 2E may include other geometrical shapes or cross sections. Also, in yet other alternate embodiments of the impetus device of FIG. 2A, the relatively sharp angles of intersections of sides of a polygon embodiment (not shown) may be utilized to differentiate between the switches and/or the notes and/or the effects produced, and the like.

Thus, analogously, the alternate exemplary embodiments shown in FIGS. 2B–2E also each comprise various switch array alternate embodiments 200B–200E, respectively. Generally, each of these alternate embodiments preferably utilize a plurality of first switch portions 204B–E, and plurality of second switch portions 206B–E, that in turn cooperate to form corresponding strata pairs respectively, that are analogous to the plurality of first and second switch portions 204, 206 of FIG. 2A.

More specifically, the alternate exemplary embodiment shown in FIG. 2B comprises a relatively flat oval-like cross section 223 so as to form an oval-like switch array 200B. This alternate embodiment utilizes a plurality of first and second switch portions 204B, 206B that are analogous to the plurality of first and second switch portions 204, 206 of FIG. 2A. Either a portion or all of either of the first and second switch portions 204B, 206B of FIG. 2B may be primarily or solely on the top portion 222 of the oval-like switch array 200B, or alternately on the bottom portion 221, or on all or portions of both the top and bottom portions 222, 221, and/or the side portions 226, 227.

The alternate embodiment of FIG. 2C is shaped as a relatively circular-like cross section 233 so as to form the cylindrical-like switch array 200C. In contrast, the spherical-like switch array 200D alternate embodiment of FIG. 2D may generally be shaped to be relatively spherical in shape. The rectangular-like switch array 200E embodiment shown in FIG. 2E comprises a rectangular cross section 253.

More specifically, the alternate exemplary embodiment cylindrical-like switch array 200C shown in FIG. 2C utilizes a plurality of first and second switch portions 204C, 206C that cooperate to form a plurality of strata pairs that are analogous to the plurality of first and second switch portions 204, 206 of FIG. 2A that cooperate to form a plurality of strata pairs. Either a portion or all of either of the first and second switch portions 204C, 206C of FIG. 2C may be primarily or solely on the top portion 232 of the switch array 200C, or alternately on the bottom portion 231, or on all or portions of both the top and bottom portions 232, 231.

Yet another embodiment is illustrated in FIG. 2D. This alternate embodiment utilizes plurality of first and second switch portions 204D, 206D that are analogous to the plurality of first and second switch portions 204, 206 of FIG. 2A. Either a portion or all of either of the first and second switch portions 204D, 206D of FIG. 2D may be primarily or solely on the top half spherical portion 242 of the switch array 200D, or alternately on the bottom half spherical portion 241, or on all or portions of both the top and bottom half spherical portions 242, 241.

More specifically, the rectangular cross sectional embodiment shown in FIG. 2E utilizes a plurality of first and second switch portions 204E, 206E that are analogous to the plurality of first and second switch portions 204, 206 of FIG. 2A. Either a portion or all of either of the first and second switch portions 204E, 206E of FIG. 2E may be primarily or solely on the top portion 252 of the switch array 200E, or alternately on the bottom portion 251, or on all or portions of both the top and bottom portions 252, 251, and/or the side portions 256, 257.

The processes occurring during a preferred musical utilization of a Panarray device will begin with the touching of the switch array 200 of FIG. 2A in one or more places. Each switch, i.e., one each of the plurality of first and second switch portions 204, 206, is formed by one pair of the plurality of first and second switch portions 204, 206 together with the interaction of the touching of this one pair of the plurality of first and second switch portions 204, 206, and this combination cooperates to initiate a data impetus. This data impetus, for example, can be embodied, for example, as a signal such as a current change. In this exemplary embodiment, as at least one each of the plurality of first and second switch portions 204, 206 are touched by the user, the capacitance drain within the switch will provoke a change in voltage at its electrical connection point address on the input bus 202 to the primary multiplexor 210. As previously described herein, there are various embodiments of sensing arrangements for the sensing impetus device of FIGS. 2A through 2E. If the touch/voltage is still present as the primary multiplexor 210 selects that address, that presence will be sensed sequentially along with the voltages of any other switches within the array also being touched, for an exemplary voltage-sided sensitive switch array embodiment, resulting in an associated generated data. Thereafter, these generated data will be associated with their original position within the array by their temporal (time sensitive) relationship with the primary binary counter 310 as illustrated in FIG. 3.

FIG. 3 illustrates an exemplary embodiment of the present invention comprising a portion of the processing logic, hereinafter "processor logic" 300. As the data leave the primary multiplexor 210, the first, middle, or last (or some representative bit voltage, that for example may chosen as a combination of processor algorithms and hardware and software design that is implemented by and per the user requirements or preferences, that are further described in more detail herein) will represent the user's touch, that is preferably defined as a first touch or a first initialization, such that this exemplary touch in question shall be identified or recognized by the D-type latch 390 as shown in FIG. 3. Also, by exiting the D-type latch 390 as shown in FIG. 3, each note data is preferably represented by just one bit. Also, the recurrence of non-positive data leaving the primary multiplexor 210 will signify the last edge of the first initialization (i.e., the first data impetus, e.g., a human touching act) recognized. As the data from the primary multiplexor 210 becomes positive in response to the next recognized initialization, it receives the same treatment as described above for the first touching or initialization.

A reflective or delayed bit of data that is created by the 256 bit shift register 380 that is located between the UART (not shown) and the primary multiplexor 210 and corresponding to the UART connection (not shown) may also be utilized. It is also understood by one skilled in the art that the 256 bit shift register 380 may alternately comprise a phase-locked-loop. This created reflective or delayed bit may be utilized to determine if the next occurrence or touch is a continuation of the previous touch or a separate individual occurrence. The purposes of utilizing such differential logic begin with providing a limitation of unnecessary repeat data through the UART but they also include altering musical attack and decay envelopes or timbre and volume of note occurrences via MIDI touch sensitivity controls.

Although not shown, it will is understood by one skilled in the art that by adding a sensor with a differential of one bit ahead or behind the previous bit would enable a nullification of the musical attack envelope status of note generation. Also, this musical attack envelope status sensor alternate embodiment is preferably electrically attached to and sensed on the message signal 309 of FIG. 3. Thus, any two bits at maximum closeness (the preset maximum closeness is preferably preset) may be utilized to trigger a nullification of the related musical attack envelope status.

The logic may be implemented essentially simply, as shown in the various illustrated exemplary embodiments, or may also include various circuitry and/or algorithms for error checking and the like. For example, in various alternate embodiments, a user may add complexity in order to distinguish a new occurrence from a sliding occurrence for the purposes of a more dramatic musical attack on the new occurrence. The difference can be distinguished in various alternate embodiments, for example, by additional circuitry (not shown) or algorithms (not shown) or a combination of both, or, e.g., a microprocessor (not shown), so as to be utilized to discern if more than a single non-positive bit has occurred between the delayed bit and the next occurrence, e.g., such as a formation of a gap. In these more complex exemplary alternate embodiments, this gap may be utilized to signify an intentionally separate musical note, and therefore provide for an enhanced musical attack envelope recognition or data impetus.

As the data leaves this exemplary embodiment system as shown in FIG. 3, it is operational in loading the proper coded (output signal multiplexor 340 and accompanying logic including the subclock circuitry interface that is comprised of the parallel tri-state buffer 330, controlling tri-state buffer 320, and the primary binary counter 310) data from the counter into a UART (not shown) where it is preferably processed for serial communication for MIDI or a MIDI like system. However, in other alternate exemplary embodiments, a non-serial communication or non-MIDI-like system may also be utilized, e.g., to provide a signal that can be interpreted by a non-MIDI or non-tonal generating system.

As shown in FIG. 3, the primary binary counter 310 is a binary counter that drives the primary multiplexor 210. The multiplexor's 210 limit must be relational to the number of switches on the switch array 200, as in the exemplary embodiment shown in FIG. 3, or in cooperation with other counters (not shown), and must be able to distinguish each individual switch's True/False ("T/F") deportment. In the exemplary embodiment of FIG. 3, the two least significant bits ("L.S.B.s")(not shown) of the primary binary counter 310 are also utilized to select the MIDI transmission channel via output signal multiplexor 340. Also, by adding or subtracting bits, with appropriate added hardware and software (not shown), then the selected MIDI channels may be changed. Similarly, other alternate embodiments may use other parts of the primary output that is generated by the output signal multiplexor 340 to select the appropriate additional configurations required when, for example, a "Bi-ART" or a "Quad-ART" is implemented (not shown). Also, additional multiplexors and associated hardware and software may be added so that the above described Bi-ART and Quad-ART's may be more efficiently utilized. Also, other alternate embodiments may utilize a set, or stack, of multiplexors (MUX's) to replace or augment primary multiplexor 210. Also, these alternate embodiments may be further appropriately modified to allow for multiple multiplexors to replace or augment primary multiplexor 210 (i.e., stacked) that may either be sensed, or swept, either serially or in parallel, or a combination of both, by the corresponding appropriately modified alternate embodiments of the remaining portions of the processor shown in FIG. 3.

In this way the primary binary counter 310, as shown in FIG. 3, operates as a MUX driving counter and as a temporal data reference between the subject bit and its associated note origin.

As illustrated in FIG. 3, the input from the switch array 200 of FIG. 2A enters the (256 bit in this exemplary embodiment) primary multiplexor 210 in a 256 bit parallel array 209.

In an exemplary embodiment as shown in FIG. 3, a primary multiplexor eight-bit parallel input 245(*a–h*) drives the control segment of the primary multiplexor 210. The from the primary multiplexor eight-bit parallel connector 245(*a–h*) is supplied along an 8-bit bus 301 by the clock input signal 302*c* along a clock input signal 302*c* and primary binary counter 310 via the primary binary counter parallel output 311(*a–h*) and the 8-bit bus 301. The eight-bit input 340 provides an output to the parallel tri-state buffer 330 via the tri-state buffer parallel input 331(*a–h*).

In the preferred embodiment as illustrated in FIG. 3, the serial output 315 from the primary multiplexor 210 begins its processing stage by truncating batches of notes. This truncation preferably utilizes a D type latch 390 with a reset function synchronized by the clock input signal 302*c* and controlled by a "not" type reset 316.

The single bit note message signals are transmitted via message signal 309 then processed via a filter comprised of a 256 bit shift register 380, a first and second and/not gates 350, 370 and an exclusive not gate 360. The exclusive not gate 360 assures that the message signal 309 is either a beginning or end note signal and sends the message signal 309 to enable the parallel tri-state buffer 330 and the controlling tri-state buffer 320 to send the note data off to the UART. The first and second and/not gates 350, 370 identify the last note held and enable the endnote message signal 341 to the output signal multiplexor 340. The second and/not gate 370 and the exclusive not gate 360 cooperate to form a portion of a decoding logic 361, that may further comprise an integrated phase locked loop function, as illustrated in this exemplary embodiment.

As shown in FIG. 3, the output signal multiplexor 340 is preferably a 16-to-8-bit multiplexor that first sends the note data (in this embodiment, the note on or note off) and channel data, present in the four least significant bits of the clock input signal 302*c* and primary binary counter 310. Second, the output signal multiplexor 340 sends the note code itself from the next six bits off the same 8-bit bus 301, which is also a continuity bus in this exemplary embodiment. In alternate embodiments, although not shown, binary adders may be attached to these signals off of the 8-bit bus 301 to alter channel selection and range placement, respectively.

The UART, although not shown, is signaled via the controlling tri-state buffer 320, the UART controlling interface connector 322, and UART parallel interface connector 332(*a–h*), to receive the first batch of data as the parallel tri-state buffer 330 opens on a signal from the subclock signal 303 at double the frequency of the main clock input signal 302*c*. The second beat of the subclock signal 303 then signals the controlling tri-state buffer 320, that may also be considered a UART load enable tri-state buffer in this exemplary embodiment to receive the note code from the parallel tri-state buffer 330.

In a preferred exemplary embodiment of the present invention, and as shown in FIG. 4, the data input portion comprises:

1) a binary counting device (eight bits is utilized for the present description) driven by a two level square wave generating circuit. In this exemplary embodiment, a two megahertz (2 MHz) subclock driving a one megahertz (1 MHz) clock driving an eight bit binary counter may be utilized; and 2) an input "keyboard" consisting of an array of "touch sensitive" "notes" such as the type described in FIGS. 2A and 3. It is also understood, e.g., that tones equaling one-eighth (⅛) of the standard whole note interval will be utilized for the present description, although other configurations are possible in various alternate embodiments.

In the exemplary embodiment shown in FIG. 4, it is understood that the clock speeds described are exemplary, and may be varied in the various alternate embodiments of the present invention. Also, "touch sensitive" in this exemplary embodiment is arranged so that a person's fingers may actuate the exemplary embodiment to generate "notes." "Notes" in the exemplary embodiments are preferred to be musical notes as known in western music.

FIG. 4 further illustrates an exemplary algorithm, comprising:

a. Step 60, Identify each affected switch by associating it with a particular count of the counter, e.g., by utilizing mux 210 or other techniques;

b. Step 70, Separate the signal of the preferred affected switch by means of D type latch 390 or other filtration techniques;

c. Step 80, Determine whether the resultant signal is a "note on" or a "note off" signal by comparing it to the previous signal via the 256 bit shift register 380, or other techniques; and d. Step 90, Reassociate signal with counter ID and prepare significant data for proper communication with the UART or synthesizer via the output signal multiplexor 340 and the parallel tri-state buffer 330, and the controlling tri-state buffer 320, or other desired techniques.

In a preferred exemplary embodiment of the present invention, and as shown in FIG. 5, the processing portion preferably comprises:

1) Four "sixty-four to one" (64×1) bit multiplexors driven by the second through seventh places (2's through 64's) of the binary counter. These four may be referred to as a 256 to 1 multiplexor (not shown). Alternatively, and as illustrated in FIGS. 2A and 3, this 256 to 1 multiplexor may utilize the single two hundred fifty-six to one (256×1) multiplexor configuration. It is understood that various other circuit configurations may be utilized within the scope of various embodiments of the present invention for all of the exemplary circuitry described herein. This 256 to 1 primary multiplexor 210 portion is driven by all eight bits of the primary binary counter 310 as shown in FIG. 3.

2) One "flip flop" type circuit per 256 to 1 multiplexor is preferably implemented to isolate the first bit of input to an 256 to 1 multiplexor from any accompanying data not distinguished by the separation of at least one note.

3) One "sixty four bit" delay type register per 256 to 1 multiplexor for the purposes of creating a "phase locked loop" comparison.

4) One "and not" logic circuits per 256 to 1 multiplexor for the purposes of distinguishing the beginning and end of the note (as intended by input) by preferably utilizing a phase locked loop type of comparison technique.

5) Placement logic for each 256 to 1 multiplexor that will refer each device (256 to 1 multiplexor) to its placement on the keyboard, and within the MIDI range of notes.

6) Two protection logic circuits per 256 to 1 multiplexor, one to prevent the signaling of two 256 to 1 multiplexor circuits simultaneously to the same UART, the second to assure the only bit acknowledged from each clump of data represents the highest or primary switch of that clump. It is also understood that this is not necessary with a 256 to 1 multiplexor configuration. This is because only note need be read simultaneously.

7) One data trim circuit per 256 to 1 multiplexor. (Returns output of "Square Wave generating Circuit" referred to in section "Data Entry" while "And Not" circuit is high.) ("Square Wave generating Circuit" should be 2× frequency of LSB of Binary Counting Device referred to in the section "Data Entry") for the purposes of enabling data entry interface on UART such as Phillips SC26C198.

FIG. 5 illustrates just one possible MIDI interface exemplary embodiment of utilizing just one of the two 8-bit packets as a first packet for utilizing MIDI transmission as described in this exemplary embodiment. In this exemplary embodiment, the second packet holds the binary address of the note data as discerned by the most significant bits of the 8-bit bus 301.

FIG. 5 further illustrates an algorithm that preferably utilizes one "sixteen to eight" bit (16×8) multiplexor (referred to as Mx type2) that is driven by (clock) pulse generator referred to in the section "Data Entry" and returning; and wherein the (clock) Pulse Generating Device referred to in the section "Data Entry" being high:

a. Step 110, 1st bit note on/off,
b. Step 120, null (free for attack/decay data),
c. Step 130, null (free for attack/decay data),
d. Step 140, null (free for attack/decay data),
e. Step 150, Channel Data from User Input,
f. Step 160, Channel Data from User Input,
g. Step 170, Channel Data from 1's place (1st bit) of Binary Counting Device referred to in the section "Data Entry,"
h. Step 180, Channel Data from 2's place (2nd bit) of Binary Counting Device referred to in the section "Data Entry."

With (clock) Pulse Generating Device referred to in the section "Data Entry" low, this exemplary embodiment and exemplary algorithm is illustrated in FIG. 6 as:

a. Step 215, Note Data from placement logic (Raw data from the 4's place (3rd bit) of Binary Counting Device referred to in the section "Data Entry"),
b. Step 220, Note Data from placement logic (Raw data from the 8's place (4th bit) of Binary Counting Device referred to in the section "Data Entry"),
c. Step 230, Note Data from placement logic (Raw data from the 16's place (5th bit) of Binary Counting Device referred to in the section "Data Entry"),
d. Step 240, Note Data from placement logic (Raw data from the 32's place (6th bit) of Binary Counting Device referred to in the section "Data Entry"),
e. Step 250, Note Data from placement logic (Raw data from the 64's place (7th bit) of Binary Counting Device referred to in the section "Data Entry"),
f. Step 260, Note Data from placement logic (Raw data from the 128's place (8th bit) of Binary Counting Device referred to in the section "Data Entry"),
g. Step 270, Note Data from placement logic,
h. Step 280, Note Data from placement logic.

Although not shown in FIG. 6, it is understood by one skilled in the art, that alternate embodiments may utilize a high signal tied to the Data Entry.

An alternate embodiment of the present invention may utilize a universal asynchronous receiver-transmitter ("UART") (not shown). Conventionally, the UART is a computer component that handles asynchronous serial communication. Most computers contain a UART to manage the serial ports, and most internal modems have their own UART.

In another alternate embodiment of FIG. 6, all data to the UART (not shown) is collected directly from the placement logic and binary counter except for the note on/off bit from the note data. The pulse generator, e.g., a subclock, triggers the UART and the visibility is triggered by the note data.

In another alternate embodiment, and as described previously, a subset of UART is utilized, namely Quad-ART. The Quad-ART as a subset of UART. The Quad-ART provides for the switching of an 8-bit number and can transmit almost any pattern. Exemplary patterns may comprise packets such as MPEG packets. The Quad-ART may translate data into any language, e.g., the MPEG packets. Thus, preferred embodiments of the present invention may be utilized for other than MIDI type transmission. Also, these transmissions, e.g., via a UART, may transmit or deliver a signal, e.g., an 8-bit or 16-bit or even larger signal, in alternate embodiments. It is understood that as the bits in the signal increase, e.g., 32, 64 or even larger, then quality is further enhanced in these alternate embodiments of the present invention. Also, in another alternate embodiment, a MIDI may utilize up to 16 lines or signals at present, but may go higher in number and are preferably integer increments, e.g., 20 lines, where each line will carry, e.g., 8, 16, 32 or even larger bit data. These lines are preferably utilized to increase bandwidth in various alternate embodiments.

In another alternate embodiment, the batch data of the multiplex selector may be trimmed to represent at least one extreme of the set. This is because in some embodiments, a user may, e.g., put their finger on one or more impetus devices, e.g., touch sensitive actuators, that may further comprise, e.g., buttons or keys, and the embodiment then transmits one or more tones at once. Depending upon how big the user's finger is relative to the button, a single finger may cause more than one button to be partially or fully actuated, e.g., depressed. Thus, a very large finger may depress 5 buttons indicating 5 tones. A preferred embodiment of the present invention then picks up or down, preferably the extreme or outside most (e.g., highest or lowest frequency) one of the tones, musically speaking. In one embodiment, the signals are trimmed to be interpreted by utilizing trimming algorithms. An exemplary trimming algorithm that may be utilized in various alternate embodiments comprises: if tone=$X_1$ is greater than the next tone $X_2$, then $X_2$ is dropped, and $X_1$ is maintained as the value of X, and so forth. Other conventional trimming algorithms may also be utilized.

FIG. 7 illustrates one possible method for relating "pressure sensitive" data to the processing circuitry of the Panarray. By mounting the FIG. 2A array of switches across a fulcrum 750 of FIG. 7, Sensors A and B can be utilized to sense the relative pressure exerted on the key 7206 at the time of allotment as selected by the control of the key selection logic 710 on an invisible latch 780 and thus introduced to a two bit bus collecting all such data in phase with selected note-on information.

In the embodiment illustrated in FIG. 7, the raw data can be converted to MIDI Language (in this case binary) by the utilization of an OR gate 740 and a conditional NAND gate 720. A spring 755 may be utilized to regulate the sensitivity as shown in this simplified embodiment.

As shown FIG. 7, the various alternate embodiments may be utilized (as may any of the embodiments of this invention) outside of the MIDI standards. For example, these various embodiments may be utilized with a faster clock speed, or by allowing control data messages to be transmitted on different channels than the channels being utilized for tone control. In yet another embodiment as shown in FIG. 7, various additional information, such as "touch sensitivity" and "after touch" data can be added to the controller signal. The data can then be added after the expected stop and start bits as a signal data "pressure" message. In some alternate embodiments, this would increase the need for speed of operation by, e.g., doubling the output of the unit.

These alternate embodiments that include after touch sensing and/or pressure sensing may, for example, transmit data by utilizing a plurality of phased invisible latches over a bus from multiple digital sensing units (preferably per key depressed) in approximately real time with data selections. In this alternate embodiment of FIG. 7, these switches are only "on," or triggered, when that key is selected, e.g., by depressing it, or physically contacting or touching that key.

Although not shown in FIG. 7, in an exemplary alternate embodiment, the same binary counter that drives the 256 multiplexor (and/or 256 multiplexor array) may also be utilized to drive the phased selections via a 256 bit stepped counter (or step counter array). In this exemplary alternate embodiment, it is preferred to fire the latches in order (phased) so as to allow the D-type latch, or other data processing, to perform interpretation of one or more data nodes, so as to operate as a data selector or alternatively to allow other data selection devices to operate.

FIG. 13 illustrates an alternate embodiment of the present invention as an exemplary digital pressure sensing embodiment. The digital pressure sense is derived by sensing how wide the batch data is, e.g., how many bits, and increasing either the velocity response or touch sense accordingly. This is possible only if the spread of the finger width is apparent within the batch data at the serial output 315. As the velocity response is increasable from 0 to 127, it is preferable to multiply most results by a number determined by the system to approximate the access to the full range available.

Also, in embodiment illustrated in FIG. 13, it is important that the system using this method of pressure sensitivity utilize also the final positive bit in the batch data to represent the note selected, as the delay in accumulating data would render it useless any other way.

FIG. 14 illustrates an alternate embodiment of the present invention as an exemplary ergonomic pressure sensing embodiment. In this ergonomic pressure sensitivity embodiment, each note sensor on the switch array must have its own pressure sensor (not shown) and buffer affixed to the appropriate 8-bit bus 1410. Each buffer will be selected by a decoder controlled by the primary binary counter 310. Sensitivity data will then be made available to the UART (not shown) via the UART parallel interface connector 332(a–h). Although two bits are used in this alternate exemplary embodiment, it is possible to mix and match different sensors and preset functions to add to the ability to express creative thought via utilization of these embodiments.

Yet other alternate embodiments may include but are not limited to various combinations of embodiments of the present invention with conventional speed sensitive controllers, touch sensitive controllers, and pressure sensitive controllers. Other exemplary alternate embodiments are wide ranging and include, but are not limited to, controllers of data that are sensitive to light, acoustical pressure, vibration, breath, heat, wind, as well as emotional, physiological or mechanical stress, and further may include mechanical controls such as joysticks, tone wheels, sliders, and pedals as well as optical data. In the utilization of alternate embodiments of the present invention, in combination with these conventional controllers, may result in an increased sense of artistic control.

Figure 9:
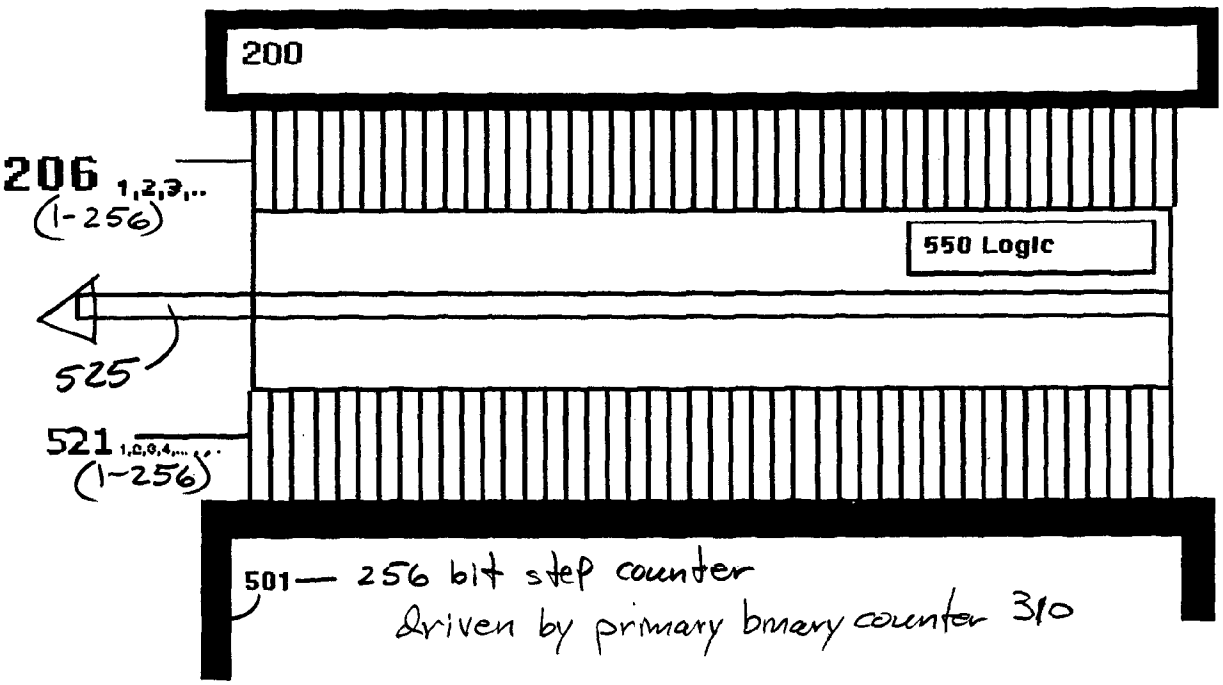
FIG. 9 illustrates an exemplary alternate embodiment relating to FIG. 3, of an exemplary portion of an improved audio tone control and generation system, method and device, in accordance with the principles of an embodiment of the present invention.

For example, FIGS. 8–9 illustrate exemplary alternate Panarray embodiments based in part on a reconfiguration of a portion of FIG. 3, e.g., the primary multiplexor 210 and the D-type latch 390 may be removed. For example, FIGS. 8 and 9 illustrate yet other alternate embodiments that are at least in part based upon an embodiment as illustrated in FIG. 3. In these alternate exemplary embodiments of FIGS. 8 and 9, the primary multiplexor 210 and the D-type latch 390 may be replaced with logic driven by a 256-bit step counter 501, or alternatively, a stack of step counters, as desired. The step counter or stack of step counters may be driven by the primary binary counter 310. This embodiment controls the selection of input data by introducing a signal to a 256 bit shift register 380 via bus 525, but first providing it passes the preferred exemplary conditional qualifications of signal logic comprising:

signal second switch portion $\mathbf{206}_n$=Yes and
signal step counter output $\mathbf{521}_n$=Yes and
signal second switch portion $\mathbf{206}_{n+1}$=No and
previous signal step counter output $\mathbf{521}_{n-1}$=No
(or any similar or equivalent statement).

Thus, the primary binary counter 310 may control a simple logic circuit comprised of "If signal second switch portion $\mathbf{206}_n$ is equal to Yes, and step counter output 521, that is comprised of the plurality of step counter outputs $\mathbf{521}_n$ is equal to Yes, and the next signal plurality of second switch portion $\mathbf{206}_{n+1}$ is equal to No, and the previous signal step counter output $\mathbf{521}_{n-1}$ is equal to No, then send that signal second switch portion $\mathbf{206}_n$ via bus 525 directly to the 256-bit shift register 380." This logic that is provided to each pair of first and second portions 204, 206 are preferably represented by signal second switch portion $\mathbf{206}_n$ and plurality of signal step counter outputs $\mathbf{521}_n$ eliminates the need for the primary multiplexor 210 and D type latch 390 and leaves the rest of this exemplary embodiment preferably unchanged from that illustrated in FIG. 3.

Although not shown in FIGS. 8 and 9, another alternate embodiment of the invention utilizes a 256-bit step counter to fire invisible latches with "note on/note off" data in phase with a binary counter described in the previous multiplexor embodiment of the present invention.

It will be understood by one skilled in the art that an exemplary "note on" may be represented as:

1001CCCC;
0NNNNNNN;
0VVVVVVV.

Also, it will be further understood that that an exemplary "note off" may be represented as:

1000CCCC;
0NNNNNNN;
0VVVVVVV.

Wherein in the above examples, "N" represents Note, "C" represents Channel, and "V" represents Volume.

Figure 10:
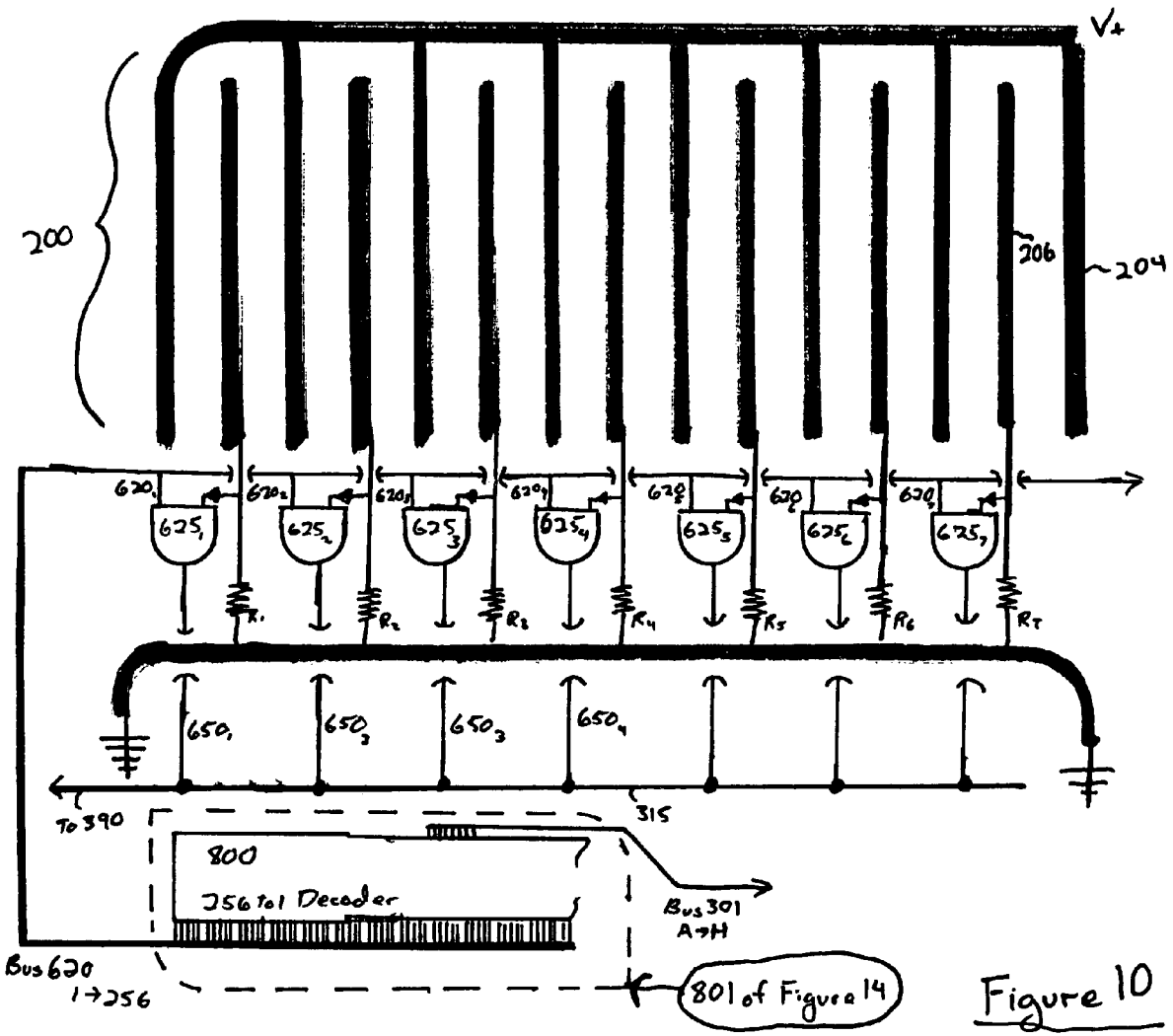
FIG. 10 illustrates an exemplary alternate embodiment relating to FIG. 3, of an exemplary portion of an improved audio tone control and generation system, method and device, in accordance with the principles of an embodiment of the present invention.

In the following described alternate embodiments of FIGS. 8, 9, and 10, the primary multiplexor 210 of FIG. 3 may be replaced by, e.g., a one (1) of 256 decoder, wherein a decoder sends one (1) of 256 high, (or low, as desired) according to a counter input acting as a selector), thus also resulting in a change of state to individual buffers and a gate for each strata pair formed from the plurality of first and second switch portions 204, 206 of FIG. 2A. Thus, in an alternate embodiment in FIGS. 8, 9, and 10, the voltage side bus is replaced by either a step counter or a 256 to 1 decoder 800 and the primary multiplexor 210 is replaced by a signal step counter output. Thus, an efficient utilization of either the 256-bit step counter 501 (or the 256 to 1 decoder 800) that replaces the 256-bit step counter 501 of FIGS. 8, 9, and 10 is instead utilized, and whichever of either the step counter embodiment or the decoder embodiment drives the 256-bit step counter 501, and the sensor—buffer output would then be fed directly to the D type latch (Decoder), then the 256 bit shift register 380, as shown in FIG. 3. The 256 to 1 decoder 800 would be driven by the primary binary counter 310 as shown in FIGS. 3 and 10. Also, it will be understood by one skilled in the art that the determining logic 550 is not necessary for the various decoder embodiments. It will also be understood by one skilled in the art that that for the alternate embodiments of either FIG. 10 or 14 may each eliminate the necessity of the determining logic 550 for the alternate embodiments as described in FIGS. 10 and 14, as compared and contrasted to the alternate embodiments of FIGS. 8 and 9 that utilizes the determining logic 550.

It will also be understood by one skilled in the art that for the embodiments shown in FIGS. 8 and 9, the note data is only high (or low, as desired) when selected and also utilizes the determining logic 550 to filter the batch data.

Also, it will be understood by one skilled in the art that for the embodiments shown in FIGS. 8, 9 and 10 the decoder is synchronized by raising only the selected switch, i.e., the decoder drives the voltage bus.

More specifically, as to the embodiment illustrated in FIG. 10, instead of the primary multiplexor 210, the plurality of first and second sensor portions 204, 206, are supplied as a quantity of 256 signal outputs represented by $\mathbf{204}_{1\text{-}256}$, $\mathbf{206}_{1\text{-}256}$ to an equal quantity of 256 compare AND-gates $\mathbf{625}_{1\text{-}256}$. Separately, an equal quantity of 256 signals are supplied via the 256 to 1 decoder 800 that is connected to the counter via 8-bit bus 301. The 256 to 1 decoder 800 outputs the equal quantity of 256 signals as individual 256 to 1 decoder outputs $\mathbf{620}_n$, i.e., one at a time, where each 256 to 1 decoder output $\mathbf{620}_n$ signal is incremented by 1, by the 256 to 1 decoder 800, and where "n" represents any signal of $\mathbf{620}_{1\text{-}256}$. The compare AND-gates $\mathbf{625}_{1\text{-}256}$, respectively, compare the two corresponding signals $\mathbf{204}_{1\text{-}256}$, $\mathbf{206}_{1\text{-}256}$ and $\mathbf{620}_{1\text{-}256}$, respectively, and the compare AND-gates $\mathbf{625}_{1\text{-}256}$ each issues a switch output signal $\mathbf{650}_{1\text{-}256}$, respectively, via the serial output 315 to the D type latch 390 of FIG. 3, only when both compared signals are high, as shown in FIGS. 3 and 10.

Figure 11:
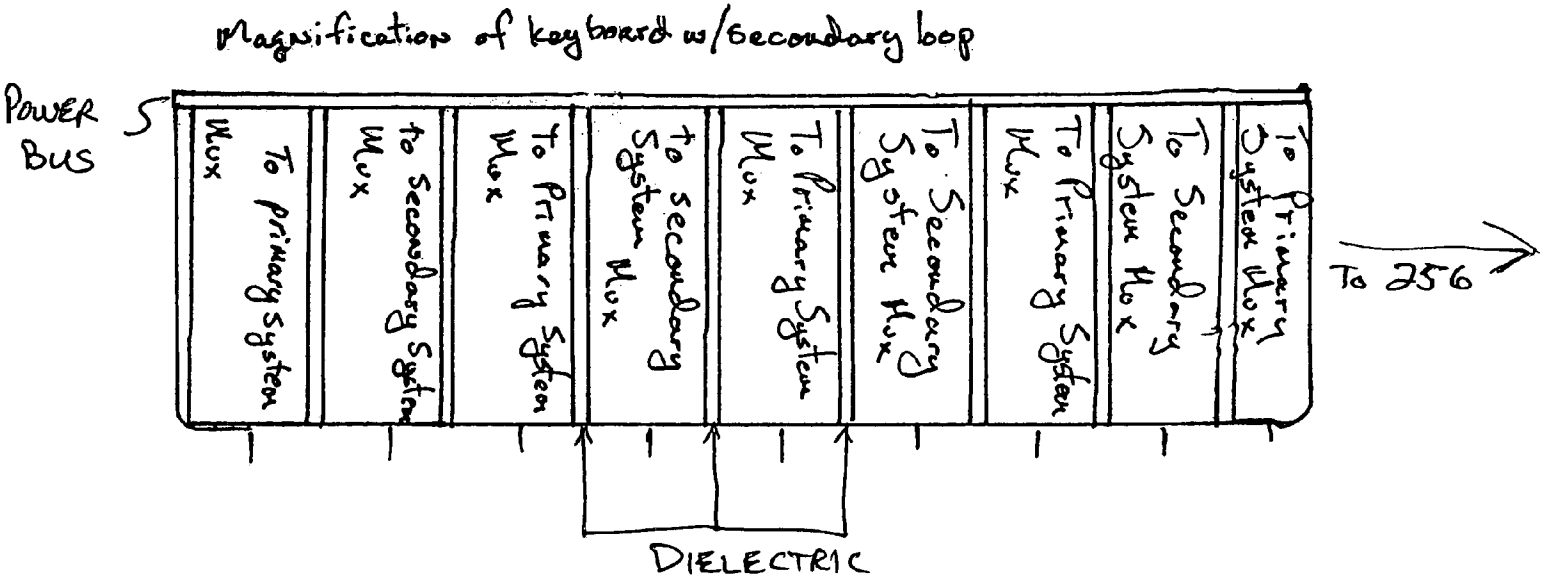
FIG. 11 illustrates an exemplary alternate embodiment relating to FIG. 3, of an exemplary portion of an improved audio tone control and generation system, method and device, in accordance with the principles of an embodiment of the present invention.
Figure 12:
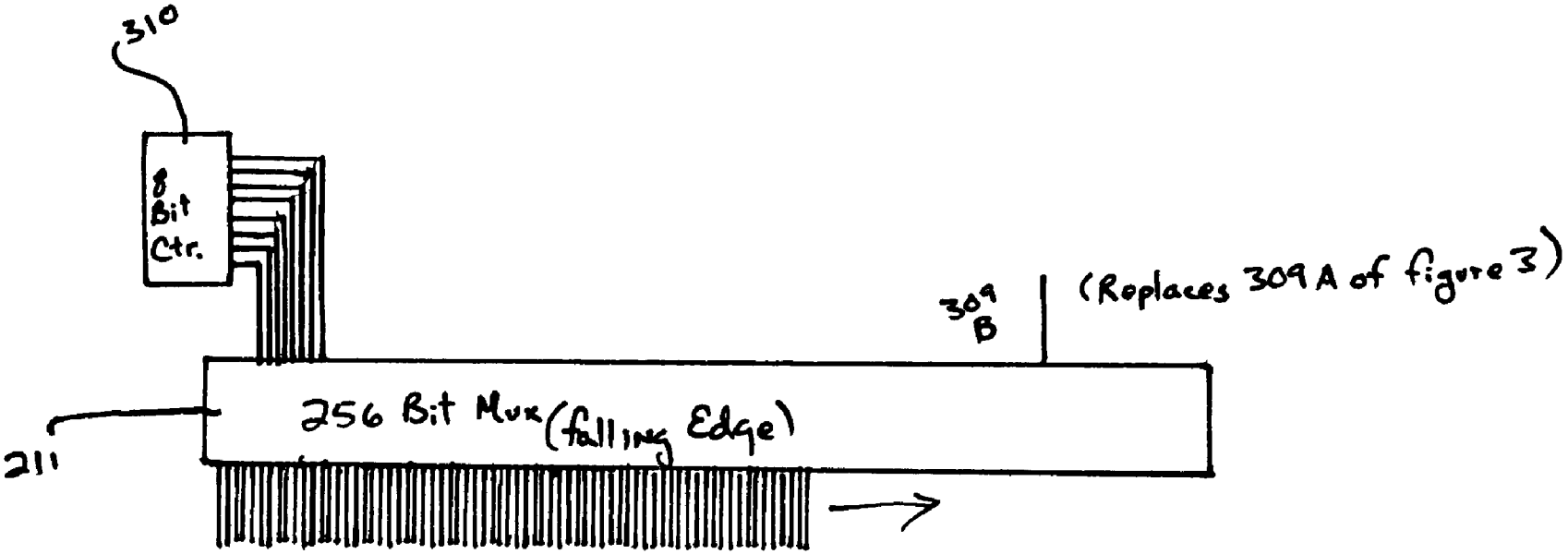
FIG. 12 illustrates an exemplary alternate embodiment relating to FIG. 3, of an exemplary portion of an improved audio tone control and generation system, method and device, in accordance with the principles of an embodiment of the present invention.

FIGS. 11 and 12 illustrate alternate embodiments of the present invention as exemplary secondary loop function embodiments. In these embodiments, the secondary loop requires two sensors on the switch array for every note available. Also, a second 256 to one (or more if more than 256 notes equivalent) that will run off the not count.

In these embodiments of FIGS. 11 and 12, the primary function of the secondary loop is to enable the decoding logic 361 to interpret two notes played side by side as separate entities rather than part of the same batch by creating a sensor between them. For this purpose, between each note sensor on the array falls another sensor representing only position data.

Also, as to any of the various embodiments of this invention, it is understood that alternate embodiments may instead comprise, for example, various non field programmable devices, e.g., an ASIC device, or field programmable logic devices ("FPLD") type devices or equivalent software emulations, as desired.

Further, as to any of the various embodiments of this invention, it is understood that alternate embodiments may instead comprise, for example, various embodiments wherein a number of chaotic source data may be input and interpreted by a data controller potion of the processor device.

Although not specifically illustrated, in yet another embodiment of the present invention, an algorithm that performs the following steps may be utilized: First, the algorithm operates to submit at least a portion of the plurality of processed data to at least one of a register array (e.g., a keyboard). Then the algorithm operates to process the plurality of data as a timed serial signal. Finally, the algorithm operates to translate the timed serial signal by a counting mechanism into an output data wherein the output data is time referenced by a counting device. It is understood by one skilled in the art that, for example, a determining of the frequency of the notes by utilizing a relationship to recurrence of data at a specific time period may be utilized wherein, for example, a binary representation of 1110101 may be set equal to the third A# note of the western musical scale, or any other relationship as desired by the user.

Preferred embodiments of the above exemplary algorithm may be dependent with serial time relationship, or inputs adaptable for parallel inputs, or both, and wherein the input device comprises one of a spectrally enhanced harmonic keyboard. Exemplary subsets of this comprise, for example, a 12-tone or chromatic keyboard, or same with sub-chromatic division without musical bias. For example, the western musical note "C" may be represented by an actuator such as a key that can be identical to any other key, of any color, and any key can be utilized to represent any note. However, preferably the keys and their associated notes are organized in a linear arrangement with the tones linear in either an ascending or descending order, e.g., such as a piano keyboard.

In a preferred embodiment of the present invention, the tones or notes are controlled and generated in a linear fashion. Thus, the present invention may emulate a linear array of tones e.g. like a piano keyboard input device. Alternately, a violin neck could be utilized to output a vibrato type of tone by varying the input device or style so that the user may create a natural vibrato over a note, or preferably over an entire chord or multiple notes at once. One exemplary embodiment comprises a vibrato on a pedal applied to more than one note at the same time, so an intuitive input is utilized and perceived by the user, e.g. a musician.

Some of the various above described embodiments of the present invention comprise a sub-chromatic polyphonic real time MIDI tone controller as primarily shown in FIG. 3. Other of the various above described embodiments of the present invention comprise a multi-channel MIDI signal processor as primarily shown in FIG. 3. Also other of the various above described embodiments of the present invention comprise a real time hardwired actuating controller, as primarily shown in FIGS. 2A–3.

In a business method embodiment of the present invention, the user may alternatively pay, for example, a monthly fee for the utilization of a tone control and generation service. Alternatively, the user may pay a per-session fee, or even a fee based upon data size, the amount of data processing and/or amount of data manipulation of the service, the cost of the product or a percentage of the cost of the product, or some licensing or other arrangement, such as a per transaction cost or any other allocation of charge the user may so desire and/or the provider may wish to provide.

Utilization of the preferred embodiments, described and understood herein, allows a user to more intuitively create, e.g., tones, chords, and the like, than by utilizing conventional sliding tone analog devices. Also, the polyphonic availability of the preferred embodiment of the present invention is not readily achievable with conventional analog devices.

Other arrangements and alternate embodiments are possible in the practice of the present invention. The above exemplary embodiments are just some of the variations that are understood as just part of the possible various embodiments of the present invention.

The invention has been described in reference to particular embodiments as set forth above. However, only the preferred embodiment of the present invention, and but a few examples of its versatility are shown and described in the present disclosure. It is understood that the present invention is capable of use in various other combinations and environments, and is capable of changes or modifications within the scope of the inventive concept as expressed herein. Also, many modifications and alternatives will become apparent to one of skill in the art without departing from the principles of the invention as defined by the appended claims.

What is claimed is:

1. A sub-chromatic polyphonic real time tone controller device for processing data, comprising:

(a) an input device, for acquiring a plurality of input data, the input device comprising a touch sensitive linear assembly, for sensing a contact of at least one first switch portion and one second switch portion approximately simultaneously by an impetus stimulus;

(b) a register, for registering at least a portion of the plurality of input data, the register comprising a musical controller;

(c) an adapter, for adapting at least a portion of the registered data for transmission as output data, wherein the output data comprises a plurality of musical note data;

the impetus stimulus comprises at least one human finger; and the plurality of first switch portions correspond to a plurality of voltage access extensions, that are electrically hot and capacitive so that when breached by a touch, a current is then induced in the corresponding second switch portions, and wherein the corresponding second switch portions comprise a corresponding plurality of individual ground access connections, which in turn trigger a corresponding plurality of input data.

2. A device as recited in claim 1, wherein the musical note data comprises a plurality of MIDI data.

3. A device as recited in claim 1, further comprising:

a translator, such that the locus of the input device for the plurality of input data is translated to the output so that the output signal is representative of the locus of the input device.

4. A device as recited in claim 3, further comprising:

a counter, the counter being triggered by the plurality of input data, and wherein the counter is triggered in approximately real time.

5. A device as recited in claim 4, wherein the plurality of input data comprises serial input data.

6. A device as recited in claim 5, further comprising:

a multiplex selector, wherein the counter is in phase with the multiplex selector.

7. A device as recited in claim 6, wherein a batch data of the multiplex selector is trimmed to represent at least one constant of a set.

8. A device as recited in claim 7, further comprising:

a trimmer, the trimmer comprising a trimming algorithm to trim the batch data, and wherein the at least one constant of a set is an extreme.

9. A device as recited in claim 8, wherein the trimmer algorithm trims a plurality of the batch data of the multiplex selector so as to represent at least one of a lower extreme and a higher extreme of a set of the batch data.

10. A device as recited in claim 1, further comprising:

a processor, for processing the plurality of input data as a timed serial signal, a counter, and a counting mechanism, for translating the timed serial signal by the counting mechanism into the output data, wherein the output data is time referenced by the counter.

11. A device as recited in claim 10, wherein the time referenced output data comprises a time length, and the time length corresponds to a time length of a musical note.

12. A device as recited in claim 11, further comprising:

a latch, for latching the timed serial signal, a trimming algorithm, that is utilized with the register to trim the plurality of input data, so as to define the data within the register and then transmit at least a portion of the data as the output data, and a programmable logic device, wherein the register comprises at least a portion of the programmable logic device.

13. A method for translating data, comprising the steps of:

(a) submitting at least a portion of a plurality on input data to at least one register array, the at least one register array further comprises at least one of a spectrally enhanced harmonic input array, a 12-tone or chromatic input array, and a 12-tone or chromatic input array with sub-chromatic division without musical bias;

(b) processing at least a portion of the submitted data as a timed serial signal;

(c) translating the timed serial signal by a counting mechanism into an output data; and (d) time referencing at least a portion of the output data by utilizing a counting device.

14. A method as recited in claim 13, wherein the submitting step further comprises at least one of a serial time relationship dependency and an input adaptable for parallel input, and further comprising the step of.

contacting at least one first switch portion and one second switch portion approximately simultaneously by an impetus stimulus, generating a signal representative of the contact for submission to a processor for processing, and processing at least one signal representative of the contact for submission to at least one register array.

* * * * *